US005484683A

United States Patent [19]

Tsukahara et al.

[11] Patent Number: 5,484,683

[45] **Date of Patent: * Jan. 16, 1996**

[54] DYE FIXING ELEMENT WITH HYDRAZINE

[75] Inventors: Jiro Tsukahara; Takanori Hioki; Koki Nakamura, all of Kanagawa, Japan

[73] Assignee: Fuji Photo Film Co., Ltd., Kanagawa, Japan

[ * ] Notice: The portion of the term of this patent subsequent to May 31, 2011, has been disclaimed.

[21] Appl. No.: 238,792

[22] Filed: May 6, 1994

Related U.S. Application Data

[63] Continuation of Ser. No. 13,098, Feb. 3, 1993, abandoned.

[30] Foreign Application Priority Data

Feb. 6, 1992 [JP] Japan ..... 4-54125

[51] Int. Cl.[6] ..... G03C 8/26; G03C 8/40; G03C 8/56

[52] U.S. Cl. ..... 430/203; 430/201; 430/214; 430/216; 430/218; 430/551

[58] Field of Search ..... 430/201, 203, 430/212, 216, 218, 214, 551, 220, 200

[56] References Cited

U.S. PATENT DOCUMENTS

| | | | |
|---|---|---|---|
| 4,499,174 | 2/1985 | Bishop et al. | 430/220 |
| 4,728,595 | 3/1988 | Hayashi et al. | 430/220 |
| 4,968,598 | 11/1990 | Nakamura et al. | 430/214 |
| 5,190,853 | 3/1993 | Seto et al. | 430/551 |
| 5,254,433 | 10/1993 | Nakamura et al. | 430/216 |
| 5,316,888 | 5/1994 | Naruse et al. | 430/216 |
| 5,340,694 | 8/1994 | Hioki et al. | 430/551 |

FOREIGN PATENT DOCUMENTS

| | | |
|---|---|---|
| 63-43145 | 2/1988 | Japan . |
| 63-256951 | 10/1988 | Japan . |

OTHER PUBLICATIONS

"Photographic products and processes", *Research Disclosure* No. 15162, Nov. 1976, pp. 76–87.

"Color diffusion transfer photographic material", *Research Disclosure* No. 16741, Mar. 1979, pp. 32 & 33.

*Primary Examiner*—Richard L. Schilling

*Attorney, Agent, or Firm*—Sughrue, Mion, Zinn, Macpeak & Seas

[57] ABSTRACT

There is disclosed a dye fixing element containing a novel compound which improves the light fastness of an image obtained by the method in which the image is formed by transferring. The above dye fixing element contains a novel hydrazine derivative represented by the following Formula (I):

Formula (I)

wherein $R_1$, $R_2$, $R_3$ and $R_4$ represent independently a substituted or unsubstituted alkyl group, cycloalkyl group, alkenyl group, or aralkyl group; $R_1$, $R_2$, $R_3$ and $R_4$ may be combined with each other to form a ring, provided that this ring is a non-aromatic heterocyclic ring and the atoms constituting the ring other than the nitrogens of Formula (I) are carbon atoms.

9 Claims, No Drawings

DYE FIXING ELEMENT WITH HYDRAZINE

This is a Continuation of application Ser. No. 08/013,098 filed Feb. 3, 1993, now abandoned.

FIELD OF THE INVENTION

The present invention relates to a dye fixing element, specifically to an element containing a novel compound which improves light fastness of an image obtained by methods in which the image is formed by transferring a dye.

BACKGROUND OF THE INVENTION

A dye fixing element is used to fix a transferred dye in methods in which an image is formed by transferring a dye. Such methods include: a color diffusion transfer method (a photographic technique by which a color image is obtained by diffusion transferring a dye imagewise formed), a heat developing color diffusion transfer method, and a dye heat transfer method (a photographic technique by which an image is obtained by thermally transferring a heat transferable dye).

In such methods, an organic dye is usually used as a dye for forming an image. However, these organic dyes are problematic because exposure to sun light and fluorescent lamp light gradually decomposes and fades them. Thus an image deteriorates over time.

In order to prevent this fading of the dye, various anti-fading agents are disclosed in JP-A-57-68833 (the term "JP-A" as used herein means an unexamined published Japanese patent application), JP-A-60-130735, JP-A-61-118748, JP-A-61-159644, JP-A-1-164940, JP-A-1-183653, and JP-A-1-28854, and JP-B-61-13740 (the term "JP-B" as used herein means an examined Japanese patent publication), JP-B-61-13741, and JP-B-61-13742.

However, these anti-fading agents are not powerful; therefore, more powerful anti-fading agents are needed.

SUMMARY OF THE INVENTION

Accordingly, an object of the present invention is to provide an excellent anti-fading agent that prevents fading of an organic dye by light to be used in a method in which an image is formed by transferring a dye. Another object is a dye fixing element containing such an anti-fading agent.

The extensive investigations made by the present inventors have resulted in the finding that the object of the present invention cain be achieved by a dye fixing element containing a hydrazine derivative represented by the following Formula (I):

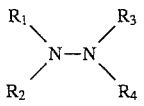

(I)

wherein $R_1$, $R_2$, $R_3$ and $R_4$ represent independently a substituted or unsubstituted alkyl, cycloalkyl, alkenyl, or aralkyl group; $R_1$, $R_2$, $R_3$ and $R_4$ may be combined with each other to form a ring, provided that this ring is a non-aromatic heterocyclic ring and the atoms constituting the ringother than the nitrogens of Formula (I), are carbon atoms.

DETAILED DESCRIPTION OF THE INVENTION

The hydrazine derivative represented by Formula (I) will be explained below in detail.

In the formula, $R_1$, $R_2$, $R_3$ and $R_4$ independently represent preferably a substituted or unsubstituted alkyl group having a total number of carbon atoms of 1 to 36 (for example, methyl, ethyl, n-butyl, t-butyl, dodecyl, octadecyl, 2-ethylhexyl, and 3,5,5-trimethylhexyl), a substituted or unsubstituted cycloalkyl group having a total number of carbon atoms of 1 to 36 (for example, cyclopentyl and cyclohexyl), an alkenyl group having a total number of carbon atoms of 1 to 36 (for example, allyl, 1-dodecene-12-yl, and 2-butene-1-yl), and a substituted or unsubstituted aralkyl group having a total number of carbon atoms of 1 to 36 (for example, benzyl, 1-phenylethyl, 2-phenylethyl, 1-naphthylmethyl, 2-naphthylmethyl, and 9-anthrylmethyl).

Of these groups, preferred is the substituted or unsubstituted alkyl group having a total number of carbon atoms of 1 to 24.

The substituents for $R_1$, $R_2$, $R_3$ and $R_4$ are an alkoxy group (for example, methoxy, ethoxy, benzyloxy, and methoxyethoxy), a halogen atom (for example, chlorine, bromine and iodine), a hydroxy group, an aryloxy group (for example, phenoxy and 1-naphthyloxy), a nitro group, a cyano group, an acylamino group (for example, acetylamino, benzoylamino, and phenoxyacetylamino), a sulfonamide group (for example, methanesulfonamide and p-toluenesulfonamide), a ureido group, an alkoxycarbonyl group (for example, methoxycarbonyl and benzyloxycarbonyl), a carbamoyl group (for example, carbamoyl, N-methylcarbamoyl, and N,N-diphenylcarbamoyl group), a sulfamoyl group (for example, sulfamoyl, N-methylsulfamoyl, and n-phenylsulfamoyl), an acyl group (for example, acetyl and benzoyl), an acyloxy group (for example, acetoxy and benzoyloxy), a sulfonyl group (for example, methylsulfonyl, dodecylsulfonyl, and phenylsulfonyl), a sulfonic acid group and a salt thereof, a carboxylic acid and a salt thereof, a phosphonic acid group and a salt thereof, an amino group, an alkylamino group (for example, methylamino, dimethylamino, and dibutylamino), an anilino group (for example, anilino, diphenylamino, and N-phenyl-N-methylamino), and a trialkylammonium group (for example, trimethylammonium, tributylammonium, dimethylhexadecylammonium, and dimethylbenzylammonium).

It is preferable that at least one of $R_1$, $R_2$, $R_3$ and $R_4$ is substituted by a hydroxy group, a sulfonic acid group or a salt thereof, or a carboxylic acid group and a salt thereof. Additionally, it is preferred that a mordant be contained in the dye fixing element containing the hydrazine of Formula (I).

In Formula (I), $R_1$, $R_2$, $R_3$ and $R_4$ may be combined with each other to form a ring, provided that this ring is a non-aromatic heterocyclic ring, and the atoms constituting the ring other than the nitrogens of Formula (I), are carbon atoms.

The preferred modes in which $R_1$, $R_2$, $R_3$ and $R_4$ are combined with each other to form a ring are represented by the following Formulas (II) to (V):

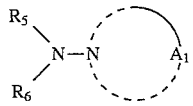

(II)

-continued (III)

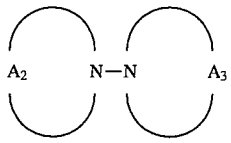

(IV)

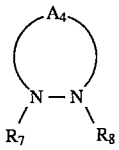

(V)

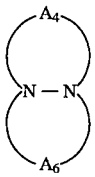

In Formulas (II) to (V), $R_5$, $R_6$, $R_7$ and $R_8$ each represent the same groups as those defined for $R_1$ to $R_4$. $A_1$, $A_2$, $A_3$, $A_4$, $A_5$, and $A_6$ each represent a group of atoms necessary to form a 4- to 10-membered ring that includes the hydrazine nitrogen atom(s), provided that of the atoms constituting the 4- to 10-membered ring formed (hereinafter referred to as a base ring), the atoms bonded to each nitrogen atom is a carbon atom.

Examples of $A_1$ to $A_6$ include a substituted or unsubstituted alkylene group (for example, ethylene, propylene, butylene, pentylene, hexylene, heptylene, octylene, and nonylene).

$A_1$ to $A_6$ may contain an alkyl group, a cycloalkyl group, an aralkyl group, an aryl group, and the above substituents identified as substituents for the base ring. Further, the other rings may be condensed with the base ring to form a bicyclo ring, wherein the ring capable of condensing therewith may be either an aliphatic ring or an aromatic ring. In case of the aromatic ring, a nitrogen atom constituting the base ring does not have to be bonded directly to the aromatic ring.

The dye fixing element containing the hydrazine derivatives of Formula (I) can be used in combination with a light-sensitive element capable of releasing an anionic azo dye, to form an image.

The concrete examples of the hydrazine derivatives of the present invention are shown below but the present invention is not limited thereto.

(1)

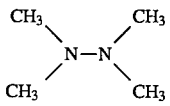

(2)

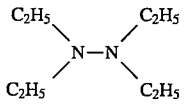

(3)

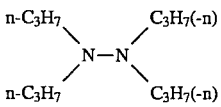

(4)

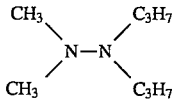

-continued (5)

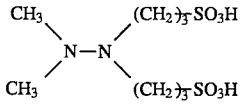

(6)

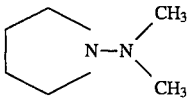

(7)

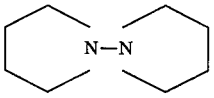

(8)

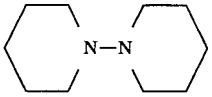

(9)

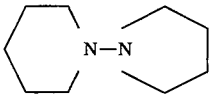

(10)

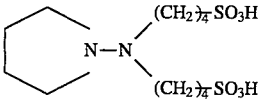

(11)

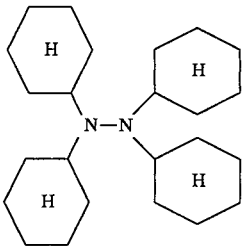

(12)

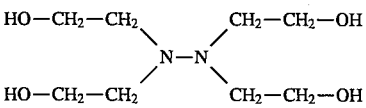

(13)

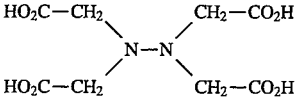

(14)

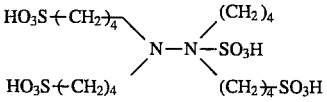

(15)

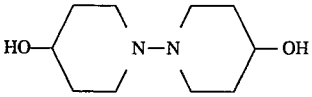

(16)

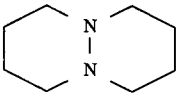

(17)

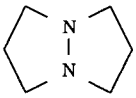

(18)

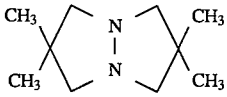

-continued (19)

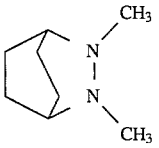

(20)

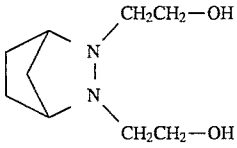

(21)

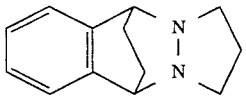

(22)

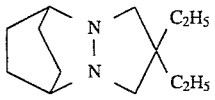

(23)

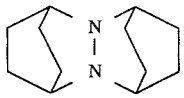

(24)

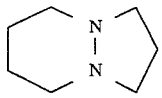

(25)

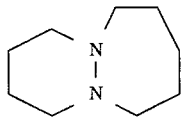

(26)

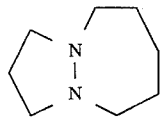

(27)

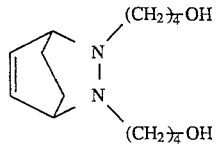

(28)

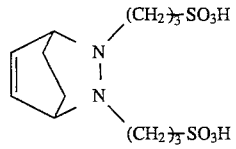

(29)

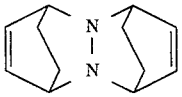

(30)

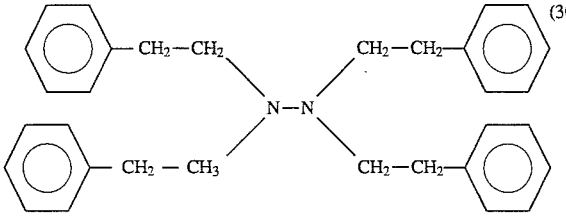

-continued (31)

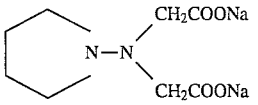

(32)

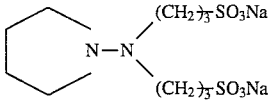

(33)

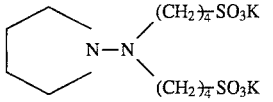

(34)

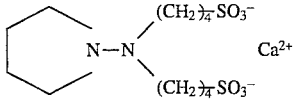

(35)

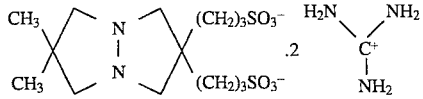

The hydrazine derivatives of the present invention can be synthesized by alkylating four hydrogens of a hydrazine hydrate one by one. Known alkylation methods include; a method of directly alkylating with halogenated alkyl or alkyl sulfonates, a method of reductively alkylating with a carbonyl compound and sodium hydrogenated cyanoborate, and a method of reducing with hydrogenated aluminum lithium after acylating. The detailed descriptions thereof can be found in, for example, *Journal of the American Chemical Society*, vol. 98, p. 5275, and vol. 112, p. 5084.

Next, the synthetic examples of the hydrazine derivatives of the present invention will be shown.

SYNTHETIC EXAMPLE 1

Synthesis of the exemplified compound (6)

1-1 Synthesis of N-dimethylaminosuccinimide

Succinic acid anhydride (40 g) was mixed with acetic acid (200 ml). N,N-dimethylhydrazine (25 g) was then added and followed by heat refluxing for 2 hours. The reaction solution was poured into ice and water and. then was adjusted to a weak alkalinity with a 5% caustic soda aqueous solution. The reaction solution was subjected to extraction with chloroform and the chloroform phase was dried over magnesium sulfate, followed by distilling off the solvent and slowly adding a 1:1 mixture of ethyl acetate and hexane while stirring, whereby the desired crystal was deposited. Amount obtained: 26 g. Yield: 44%.

1-2 Synthesis of dimethylaminopyrrolidine

Hydrogenated aluminum lithium (27 g) was mixed with tetrahydrofuran (300 ml). While stirring at 0° C., synthesized N,N-dimethylSuccinimide (20 g) dissolved in tetrahydrofuran (100 ml), was dropped therein over a period of 20 minutes. A 15% caustic soda aqueous solution (30 ml) was added to the reaction solution. Then water 70 ml was carefully added. Deposited crystals were filtered out and the filtrate was extracted with methylene chloride, followed by drying and concentrating the extract, which was oily. Amount obtained: 1.5 g. Yield: 9%.

SYNTHETIC EXAMPLE 2

Synthesis of the exemplified compound (18)

2-1 Synthesis of 1,2-bis-(1-chloro-2,2-dimethylpropionyl-)hydrazine

Hydrazine hydrate (16.0 g) was mixed with water (300 ml), and ice (200 g) was added, followed by stirring. Chloropivaloyl chloride (100 g) was slowly dropped therein. As the reaction proceeded, a solid matter was deposited. After finishing the reaction, methanol (200 ml), water (100 ml) and ethyl acetate (500 ml) were added and the desired compound was extracted with ethyl acetate. An organic phase was dried over magnesium sulfate and then the solvent was distilled under a reduced pressure. Water was added to the residue for crystallization to filtrate the crystals. Amount obtained: 81 g. Yield: 94.0%. Melting point: 206° to 207° C.

2-2 Synthesis of 1,5-diaza-2,6-dioxo-3,3,7,7-tetramethylbicyclo[ 3,3,0]octane

The compound (80 g) synthesized in Synthetic Example 1 was dissolved in methanol (200 ml) and a sodium methoxide 28% by weight methanol solution (200 ml) was added thereto. After heat refluxing for 5 hours, methanol was distilled off under reduced pressure. Methanol (200 ml) was added to the residue and a solid matter was filtered. The filtrate was concentrated and then refined with a column chromatography using Sephadex LH-20 as a carrier and methanol as an eluting liquid. Recrystallization was carried out with water to thereby obtain the desired compound. Amount obtained: 21 g. Yield: 36.0%. Melting point: 164° to 167° C.

2-3 Synthesis of 1,5-diaza-3,3,7,7-tetramethylbicyclo[3,3,0] octane

The compound (17 g) synthesized in Synthetic Example 2 was dissolved in tetrahydrofuran (200 ml) and hydrogenated aluminum lithium (7 g) was added little by little. After heat refluxing for 6 hours, the reaction solution was poured in ice and water and adjusted to an alkalinity with sodium hydroxide, followed by adding ethyl acetate (300 ml) to carry out an extraction. The solvent was distilled off from an organic phase under reduced pressure. The residue was then refined with a column chromatography using alumina as a carrier. After a fraction of the desired compound was collected and the solvent was concentrated, the residue was dissolved in ethyl acetate. Oxalic acid anhydride (10 g) was added and dissolved by heating. Cooling formed crystals. These crystals were filtrated to thereby obtain an oxalic acid salt of the desired compound. Amount obtained: 4.5 g. Yield: 20.1%.

This oxalic acid salt was dissolved in methanol and then neutralized with an excessive amount of $NaHCO_3$. A solid matter was filtered out and the filtrate was concentrated under reduced pressure to thereby obtain an oily desired compound.

The isolation of the hydrazine derivative of the present invention as a salt is advantageous in a synthesis in some cases and the isolation as the salt does not cause any trouble. Preferred salts include: an oxalic acid salt, a hydrogenoxalic acid salt, a hydrochloric acid salt, a sulfuric acid salt, a sulfurous acid salt, a nitric acid salt, an organic sulfonic acid salt, an organic carboxylic acid salt, a phosphoric acid salt, carbonate, and bicarbonate.

Next, the dye fixing element in which the hydrazine derivative of the present invention is used will be explained in detail.

The dye fixing element of the present invention has at least one layer containing the hydrazine derivative of the present invention and is used as an image-receiving layer or an image-receiving element in a method of forming an image by transferring a dye (for example, a color diffusion transfer method, a heat development color diffusion transfer method, and a dye heat transfer method).

The term "contains the hydrazine derivative of the present invention" means to contain it after image forming processing. Included in the scope of the present invention is, for example, a technique in which the hydrazine derivative of the present invention is not contained in the dye fixing element before the image forming processing. The transfer of the hydrazine derivative of the present invention together with the dye during the image forming processing or the use of any means (for example, dipping in a solution of the hydrazine derivative of the present invention) after the image forming processing results in incorporating the hydrazine derivative of the present invention into the dye fixing element.

The amount of the hydrazine derivative of the present invention used for the dye fixing element of the present invention can be suitably determined according to the kind and amount of a dye to be fixed and the image forming process used. As one standard, it is 0.1 to 1000 mole % based on the total amount of the dyes, or $1\times10^{-6}$ to $1\times10^{-2}$ mole/$m^2$, preferably 0.1 to 200 mole % or $1\times10^{-5}$ to $2\times10^{-3}$ mole/$m^2$.

The low volatility of the hydrazine derivative of the present invention is very important for fostering the anti-fading effect of the hydrazine derivative over a long period of time. Preferably, the hydrazine derivative has a molecular weight of 200 or more or possesses a group such as a hydroxy group, a carboxylic acid or a salt thereof, and a sulfonic acid group or a salt thereof.

In the present invention, a conventional anti-fading agent may be used in combination with the hydrazine derivative of the present invention. Appropriate conventional anti-fading agent include: an anti-oxidation agent, a UV absorber and a metal complex.

Examples of anti-oxidation agents include: a chroman series compound, a coumarane series compound, a phenol series compound (for example, hindered phenols), a hydroquinone derivative, a hindered amine derivative, and a spiroindane series compound. JP-A-61-159644 describes effective compounds as well.

Examples of UV absorbers include: the benzotriazole series compounds (U.S. Pat. No. 3,533,794), the 4-thiazolidone series compounds (U.S. Pat. No. 3,352,681), the bezophenone series compounds (JP-A-56-2784), and the other compounds described in JP-A-54-48535, JP-A-62-136641 and JP-A-61-88256. Furthermore, the UV absorptive polymers described in JP-A-62-260152 are effective as well.

Examples of metal complexes include the compounds described in U.S. Pat. Nos. 4,241,155, 4,245,018 (columns 3 to 36), and 4,254,195 (columns 3 to 8), and JP-A-62-174741, JP-A-61-88256 (pages 27 to 29), JP-A-62-234103, JP-A-62-31096 and JP-A-62-230596.

Examples of useful anti-fading agent are described in JP-A-62-215272 (pages 125 to 137).

These anti-fading agents may previously be incorporated into an image-receiving element or may be supplied to the image-receiving element from the outside, for example, by diffusing the agents from a light-sensitive element.

The above anti-oxidation agent, UV absorber and metal complex may be used in combination or by themselves.

Next, a color diffusion transfer method, a heat development color diffusion transfer method, and a dye heat transfer method, each of which is a useful embodiment of the present invention, will be explained in sequence.

First, the color diffusion transfer method will be described below.

A representative form of a film unit used for the color diffusion transfer method is the form in which an image receiving element (a dye fixing element) and a light-sensitive element are provided on a transparent support; it is not necessary to peel off the light-sensitive element from the image receiving element after completely transferring an image. More concretely, the image-receiving element consists of at least one mordant layer. Meanwhile, in a preferred embodiment of the light-sensitive element, the combination of a blue-sensitive emulsion layer, a green-sensitive emulsion layer and a red-sensitive emulsion layer or the combination of a green-sensitive emulsion layer, a red-sensitive emulsion layer and an infrared-sensitive emulsion layer is combined with a yellow dye-providing material, a magenta dye-providing material and a cyan dye-providing material for the above respective emulsion layers to constitute the light-sensitive element (wherein "the infrared-sensitive emulsion layer" means an emulsion layer having a sensitivity at 700 nm or more, particularly 740 nm or more). A white color reflection layer containing a solid pigment, such as titanium oxide, is provided between the above mordant layer and light-sensitive layer or dye-providing material-containing layer so that a transferred image can be enjoyed through the transparent support.

Further, a light shielding layer may be provided between the white color reflection layer and light-sensitive layer so that a development processing can be completed under daylight. A peeling layer may be provided at a suitable portion so that all or a part of the light-sensitive element can be peeled off from the image-receiving element if required (such the embodiment is described in, for example, JP-A-56-67840 and Canadian Patent 674,082).

Further, there is available as an another embodiment of a laminating and peeling type, a color diffusion transfer photographic film unit characterized by comprising a light-sensitive element having (a) a layer functioning as a neutralizer, (b) a dye-receiving layer, (c) a peeling layer, and (d) at least one silver halide emulsion layer combined with a dye image-forming material each provided in order on a white color support, an alkali processing composition containing a light shielding agent, and a transparent cover sheet, and having a layer having a light shielding function on the side opposite to the side on which the emulsion layer and processing composition are provided, as disclosed in JP-A-63-226649.

In another form, in which peeling is not necessary, the above light-sensitive element is provided on one transparent support and a white color reflection layer is provided thereon; Further, an image-receiving layer is provided thereon. U.S. Pat. No. 3,730,718 describes an embodiment in which an image-receiving layer, a white color reflection layer, a peeling layer and a light-sensitive element are provided on the same support and the light-sensitive element is intentionally peeled from the image-receiving element.

Meanwhile, a representative form in which a light-sensitive element and an image-receiving element are independently coated on the two supports, respectively, are roughly divided into two categories; one is a peeling type and the other is a peeling-unnecessary type. To explain these in detail, a preferred embodiment of a peeling type film unit has at least one image-receiving layer provided on one support and a light-sensitive element is provided on a support having a light shielding layer. It is designed so that a light-sensitive layer coating face and a mordant layer-coating face are not opposite before finishing an exposure, and the light-sensitive layer-coating face is upset after finishing the exposure (for example, during a development processing) to be superposed on the image-receiving layer-coating face. After a transferred image is completed on the mordant layer, the light-sensitive element is immediately peeled from the image-receiving element.

Meanwhile, in a preferred embodiment of a peeling-unnecessary type film unit, at least one mordant layer is provided on a transparent support and a light-sensitive element is provided on a transparent support or a support having a light shielding layer, wherein a light-sensitive layer-coating face and a mordant layer coating face are oppositely superposed.

Further, a vessel (a processing element) containing an alkali processing composition and capable of being broken by applying a pressure may be combined with the forms mentioned above. Among them, in the peeling-unnecessary type film unit in which an image receiving element and a light-sensitive element are provided on one support, this processing element is provided preferably between the light-sensitive element and a cover sheet superposed thereon. In the form in which a light-sensitive element and an image-receiving element are independently provided on two supports, respectively, a processing element is preferably provided between the light-sensitive element and image-receiving element in a development processing at latest. The processing element contains preferably a light shielding agent (for example, carbon black and a dye the color of which changes according to pH) and/or a white pigment (titanium oxide and others). Furthermore, in a color diffusion transfer system film unit, a neutralization timing mechanism consisting of the combination of a neutralizing layer and a neutralization timing layer is preferably incorporated into a cover sheet, an image-receiving element or a light-sensitive element.

The image-receiving element of the color diffusion transfer method will be explained below in more details.

The image-receiving element in the color diffusion transfer method has preferably at least one layer containing a mordant (a mordant layer). The publicly known compounds can be used as the mordant agent. There are filed as the concrete examples thereof, the patents such as British Patents 2,011,912, 2,056,101, and 2,093,041, U.S Pat. Nos. 4,115,124, 4,273,853, and 4,282,305, and JP-A-59-232340, JP-A-60-118834, JP-A-60-128443, JP-A-60-122940, JP-A-60-122921, and JP-A-60-235134.

In the present invention, where a mordant layer is used, the hydrazine derivative of the present invention has to be present in this mordant layer.

In addition thereto, there may be incorporated into the mordant layer, a natural or synthetic hydrophilic heteropolymer generally used in a photographic field, such as gelatin, polyvinyl alcohol, and polyvinyl pyrrolidone.

Besides, various additives can suitably be used in the image-receiving element used during the color diffusion transfer method. These additives will be explained during the discussion of a dye fixing element (an image receiving element) used during a heat development color diffusion transfer method.

Next, the light-sensitive element in the color diffusion transfer method will be explained.

A useful dye image-forming material in the light-sensitive element used for the color diffusion transfer process is a non-diffusible compound releasing a diffusible dye (possibly a dye precursor) in relation to silver development, or a compound in which a diffusibility of itself changes as is described in *The Theory of the Photographic Process,* 4th edition. Any of these compounds can be represented by the following Formula (A):

$$\text{DYE-Y} \qquad \text{(A)}$$

wherein DYE represents a dye or a precursor thereof and Y represents a component which releases a compound having a diffusibility different from that of the above compound under an alkaline condition. The function of this Y roughly classifies these compounds as both a negative type compound that provides diffusibility in a silver developing portion and a positive type compound that provides diffusibility at a non-developing portion.

A compound that is oxidized and split during development to release a diffusible dye is a the concrete example of the negative type Y.

The concrete examples of Y are described U.S. Pat. No. 3,928,312 and others described in JP-A-2-32335, a right upper column, line 18 at p. 15 to a left lower column, line 20 at p. 15.

Particularly preferred example of Y's in the negative type dye-releasing redox compounds is an N-substituted sulfamoyl group (as an N-substituent, a group derived from an aromatic hydrocarbon group and a hetero ring). The representative examples of this Y are shown below, but not limited only thereto.

The descriptions in a left upper column at p. 16 to a right lower column, line 7 at p. 17 of JP-A-2-32335 are applied to the representative examples of Y, the positive type compounds and the other type compounds.

The descriptions in a right lower column, line 8 at p. 17 to a right lower column, line 19 at p. 20 of JP-A-2-32335 are applied to a silver halide emulsion, a spectral sensitizing dye, an emulsion layer, a full color multi-layer constitution, a processing composition, and a color diffusion transfer process film unit and a constituent layer thereof each used for the color diffusion transfer process.

Next, the heat developing color diffusion transfer process will be explained.

The image-receiving element in the heat developing color diffusion transfer process is fundamentally the same one as the image-receiving element in the color diffusion transfer process. In the present invention, the hydrazine derivative of the present invention is present preferably in the mordant layer in the image receiving-element as already described.

A heat developing light-sensitive element has fundamentally a light-sensitive silver halide, a binder, and a dye-providing compound (a reducing agent serves both in some cases as will be described later) on a support and can contain an organic metal salt oxidizing agent as needed. These components are added to the same layer in many cases and it is possible as well to divide and add them to different layers as long as they can be reacted. For example, the presence of a colored dye-providing compound in a lower layer than a silver halide emulsion layer can prevent sensitivity from lowering. A reducing agent is contained preferably within the heat developing light-sensitive element. Additionally, the reducing agent can be supplied from the outside, for example, by a method in which it is diffused from the image-receiving element (a dye fixing element).

In order to obtain a wide range of colors falling within a chromaticity diagram using the three primary colors of yellow, magenta and cyan, at least three silver halide emulsion layers having sensitivities in the respective different spectral regions are combined and used. There are given, for example, the combination of a blue-sensitive layer, a green-sensitive layer and a red-sensitive layer and the combination of a green-sensitive layer, a red-sensitive layer and an infrared-sensitive layer. The respective light-sensitive layers can have various arrangement orders which are known in a conventional type color light-sensitive element. Furthermore, these respective light-sensitive layers may be divided into two or more layers according to necessity.

The heat developing light-sensitive element can be provided with various auxiliary layers such as a protective layer, a subbing layer, an intermediate layer, a yellow filter layer, an anti-halation layer, and a back layer.

The descriptions in a right lower column, line 10 at pp. 21 to a right lower column, line 2 at pp. 29 of JP-A-2-32335 are applied to silver halide, a silver halide emulsion, an organic metal salt oxidizing agent, an anti-fogging agent, a photographic stabilizer, and a binder each used for the heat developing light-sensitive element, a constitution layer of the heat developing light-sensitive element or dye fixing element, a reducing agent, an electron transfer agent, and an electron donating material each used for the heat developing element, a dye-providing compound capable of being used for the heat developing element, a compound intended for stabilizing an image, the constitution layers of the heat developing light-sensitive element and dye fixing element, a fluorescent whitening agent, a harder, a surface active agent, an organic fluoro compound, a matting agent, a heat solvent, a deforming agent, a fungicide/anti-mold agent, colloidal silica, an image forming accelerator, and base or a base precursor each used therefor, a support used for the heat developing light-sensitive element or dye fixing element, a heating means in a heat development, a heat developing step, a movable solvent (solvent) in the heat development, a heat development equipment, and an exposing method.

Next, the dye heat transfer process will be explained in detail.

In the dye heat transfer process, a heat transfer dye-providing material is superposed on a heat transfer image-receiving material and heat energy corresponding to an image information is applied from either side thereof, preferably from the back face of the heat transfer dye-providing material. Heat is provided with a heating means, for example, such as a thermal head to enable the dye of a dye providing layer to be transferred to the heat transfer image-receiving material according to the amount of the applied heat energy, whereby a color image having a gradation with an excellent sharpness and resolution can be obtained. An anti-fading agent can be transferred as well in the similar manner.

The heating means is not limited to a thermal head but includes publicly known means such as a laser ray (for example, a semiconductor laser), an infrared flash, and a heat pen.

When a laser is used as a heat source, a heat transfer dye-providing material preferably contains a material strongly absorptive of laser rays. The irradiation of the laser rays on the heat transfer dye-providing material causes this absorptive material to convert light energy to heat energy. The heat is then transported to a dye very close thereto, whereby the dye is heated to a temperature at which it is transferred to a heat transfer image-receiving material.

This absorptive material is present under the dye in the form of a layer and/or mixed with the dye.

More detailed explanation of the instant process is described in British Patent 2,083,726A.

Several kinds of lasers can be used as the above laser but a semiconductor laser is preferred in terms of compactness, low cost, stability, reliability, durability, and ease of modulation.

The details of a heat transfer recording method can be referred to the description of JP-A-60-34895.

The heat transfer image-receiving material comprises a support and provided thereon an image-receiving layer which receives a dye transferred from a dye-providing material. This image-receiving layer (a dye fixing element) is preferably the layer with a thickness of not much more than 5 to 50 μm either singly or in combination with the other binder materials. The binder materials are capable of receiving a heat migrating dye from the heat transfer dye-providing material during printing and fix the heat migrating dye therein. In the present invention, the hydrazine derivative of the present invention is present in this layer.

There can be given the following materials as the polymers which are the representative examples of the materials capable of receiving the heat migrating dye:

(1) Polymers having an ester bond, such as a polyester resin.

(2) Polymers having a urethane bond, such as a polyurethane resin.

(3) Polymers having an amide bond, such as a polyamide resin.

(4) Polymers having a urea bond, such as a urea resin.

(5) Polymers having a sulfone bond, such as a polysulfone resin.

(6) Other polymers having a high-polar bond, such as a polycaprolactone resin, a styrene-maleic anhydride resin, a polyvinyl chloride resin, and a polyacrylonitrile resin.

In addition to the above synthetic resins, the mixture of these polymers or the copolymers thereof can be used as well.

A high-boiling solvent or a heat solvent can be incorporated into the heat transfer image-receiving material, particularly into the image-receiving layer as the material capable of receiving the heat migrating dye or a diffusion aid for the dye.

The image-receiving layer in the heat transfer image-receiving material may provide the material capable of receiving the heat migrating dye dispersed in a water soluble binder. Various publicly known water soluble polymers can be used as the water soluble binder used. Preferred is a water soluble polymer having a group capable of carrying out a crosslinking reaction with a hardener.

The image-receiving layer may be composed of two or more layers. In that case, the image-receiving layer is preferably structured so that a synthetic resin having a lower glass transition point is used in the layer closer to the support in which a high-boiling solvent and a heat solvent are used to increase a fixability to a dye. A synthetic resin having a higher glass transition point is used as an outermost layer and the amount of the high boiling organic solvent and heat solvent used is reduced to a minimum or not used at all to prevent the problems, such as surface stickiness, adherence to other materials, retransferring of a dye after transfer, and blocking with a heat transfer dye-providing material.

The total thickness of the image-receiving layer is preferably in the range of 0.5 to 50 μm, particularly 3 to 30 μm. Where the image-receiving layer is of the two layer structure, the thickness of the outermost layer is preferably 0.1 to 2 μm, particularly 0.2 to 1 μm.

The image-receiving layer may contain a dye fixing agent as needed. Dye fixing agents can be any of the mordants described in JP-A-3-83685 or the compounds described in JP-A-1-188391.

The heat transfer image-receiving material may have an intermediate layer between a support and the image-receiving layer. The intermediate layer functions as a cushion layer, a porous layer, an anti-dye diffusion layer by constituent material and/or an adhesive.

Any support can be used as a heat transfer image-receiving material, as long as it satisfies the requirements of smoothness, whiteness degree, slip property, friction property, an antistatic property, and cratering after transferring.

A fluorescent whitening agent may be used in the heat transfer image-receiving material.

The heat transfer dye-providing material can be used in the form of a sheet, a continuous roll or a ribbon. Each of a cyan dye, a magenta dye and a yellow dye which is used in combination therewith is provided on a support so that each of them usually forms an independent region. For example, a yellow dye region, a magenta dye region and a cyan dye region are provided in face order or line order on one support. Further, the above yellow dye, magenta dye and cyan dye are independently contained in the three heat transfer dye-providing materials provided on the support and each of the dyes can be transferred in sequence to one heat transfer image-receiving material.

Each of a cyan dye, a magenta dye and a yellow dye which is used in combination therewith can be dissolved or dispersed in a suitable solvent together with a binder resin to apply it on a support or print it on the support by a printing method such as a gravure process. A thickness of a dye-providing layer containing these dyes in terms of a dry thickness is usually set at the range of about 0.2 to 5 μm, particularly preferably 0.4 to 2 μm.

A coated amount of the dye is preferably 0.03 to 1.0 g/m$^2$, more preferably 0.1 to 0.6 g/m$^2$.

Any of the dyes used for the conventional heat transfer dye-providing materials can be used as the heat transferable dye used for the heat transfer dye-providing material of the present invention. Particularly preferred in the present invention is the dye having a small molecular weight of not much more than about 150 to 800 which can be selected for its transfer temperature, hue, light fastness, solubility in an ink and a binder resin, and dispersibility.

Examples include a dispersion dye, a basic dye, and an oil soluble dye. Particularly preferably used are Sumikaron Yellow E4GL, Dianix Yellow H2G-FS, Miketon Polyester Yellow 3GSL, Kayaset Yellow 937, Sumikaron Red EFBL, Dianix Red ACE, Miketon Polyester Red B, Kayaset Red 126, Miketon Fast Brilliant Blue B, and Kayaset Blue 136.

Preferable yellow dyes are described in JP-A-59-78895, JP-A-60-28451, JP-A-60-28453, JP-A-60-53564, JP-A-61-148096, JP-A-60-239290, JP-A-60-31565, JP-A-60-30393, JP-A-60-53565, JP-A-60-27594, JP-A-61-262191, JP-A-60-152563, JP-A-61-244595, JP-A-62-196186, JP-A-63-142062, JP-A-63-39380, JP-A-62-290583, JP-A-63-111094, JP-A-63-111095, JP-A-63-122594, JP-A-63-71392, JP-A-63-74685, and JP-A-63-74688; the magenta dyes described in JP-A-60-223862, JP-A-60-28452, JP-A-60-31563, JP-A-59-78896, JP-A-60-31564, JP-A-60-303391, JP-A-61-227092, JP-A-61-227091, JP-A-60-30392, JP-A-60-30694, JP-A-60-131293, JP-A-61-227093, JP-A-60-159091, JP-A-61-262190, JP-A-62-33688, JP-A-63-5992, JP-A-61-12392, JP-A-62-55194, JP-A-62-297593, JP-A-63-74685, JP-A-63-74688, JP-A-62-97886, JP-A-62-132685, JP-A-61-163895, JP-A-62-211190, and JP-A-62-99195; and the cyan dyes described in JP-A-59-78894, JP-A-60-31559, JP-A-60-53563, JP-A-61-19396, JP-A-61-22993, JP-A-61-31467, JP-A-61-35994, JP-A-61-49893, JP-A-61-57651, JP-A-62-87393, JP-A-63-15790, JP-A-63-15853, JP-A-63-57293, JP-A-63-74685, JP-A-63-74688, JP-A-59-227490, JP-A-59-227493, JP-A-59-227948, JP-A-60-131292, JP-A-60-131294, JP-A-60-151097, JP-A-60-151098, JP-A-60-172591, JP-A-60-217266, JP-A-60-239289, JP-A-60-239291, JP-A-60-239292, JP-A-61-148269, JP-A-61-244594, JP-A-61-255897, JP-A-61-284489, JP-A-61-368493, JP-A-62-132684, JP-A-62-138291, JP-A-62-191191, JP-A-62-255187, JP-A-62-288656, JP-A-62-311190, and JP-A-63-144089.

Any of the conventional binder resins can be used in the present invention in combination with the above dyes. Usually, the binder resins that have a high heat resistance and do not prevent the dyes from transferring during heating are selected. Examples of resins used in the present invention include: a polyamide series resin, a polyester series resin, an epoxy series resin, a polyurethane series resin, a polyacrylic series resin (for example, polymethyl methacrylate, polyacrylamide, and polystyrene-2-acrylonitrile), a vinyl series resin including polyvinylpyrrolidone, a polyvinyl chloride series resin (for example, a copolymer of vinyl chloride-vinyl acetate), a polycarbonate series resin, polystyrene, polyphenylene oxide, a cellulose series resin (for example, methylcellulose, ethylcellulose, carboxymethyl cellulose, cellulose acetate biphthalate, cellulose acetate, cellulose acetate propionate, cellulose acetate butylate, and cellulose triacetate), a polyvinyl alcohol series resin (for example, polyvinyl alcohol and a partially saponified polyvinyl alcohol such as polyvinyl butyral), a petroleum series resin, a rosin derivative, a cumarone-indene resin, a terpene series resin, and a polyolefin series resin (for example, polyethylene and polypropylene).

In the present invention, the binder resin is used preferably in a ratio of, for example, about 20 to 600 parts by weight per 100 parts by weight of the dye.

In the present invention, any conventional ink solvents can be used for dissolving or dispersing the above dyes and binder resins.

Any conventional support can be used in the heat transfer dye-providing material. Examples include: polyethylene terephthalate, polyamide, polycarbonate, a glassine paper, a condenser paper, cellulose ester, a fluorinated polymer, polyether, polyacetal, polyolefin, polyimide, polyphenylene sulfide, polypropylene, polysulfon, and cellophane.

In general, the thickness of the support for the heat transfer dye-providing material is 2 to 30 μm.

A slipping layer may be provided in order to prevent a thermal head from sticking to the dye-providing material. This slipping layer is composed of a lubricating material containing a surface active agent, a solid or liquid lubricant, or a mixture thereof. The slipping layer might also contain a polymer binder.

To prevent sticking and sliding of a thermal head by heat during printing from a back, a dye-providing material is preferably provided with an anti-sticking treatment on the support side on which the dye providing layer is not provided.

The dye-providing material may be provided with a hydrophilic barrier layer for preventing a diffusion of a dye toward the direction of a support. The hydrophilic dye barrier layer contains a hydrophilic material useful for an intended purpose.

The dye-providing material is provided with a subbing layer.

In the present invention, in order to improve mold releasing performance of the dye-providing material and image-receiving material, a mold releasing agent is incorporated into the layer constituting the dye-providing material and/or image-receiving material, most preferably into an outermost layer corresponding to the plane at which both materials contact.

The layers constituting the dye-providing material and image-receiving material may be hardened with a hardener.

Examples of hardeners include: a vinyl sulfone series hardener (N,N'-ethyelene-bis(vinyl sulfonylacetamide)ethane), an N-methylol series hardener (dimethylolurea and others), or a high molecular hardener (the compounds described in 62-234157 and others).

An anti-fading agent other than the hydrazine derivative of the present invention may be used in the heat transfer dye-providing heat transfer material and image-receiving material. Anti-fading agents include: an oxidizing agent, a UV absorber and a metal complex.

The anti-fading agent used to prevent fading of a dye transferred onto an image-receiving material may be incorporated into the image-receiving material or supplied from an outside to the image-receiving material by a method, such as allowing it to be transferred from the dye-providing material.

The above oxidizing agent, UV absorber and metal complex may be used in combination or by themselves.

Various surface active agents can be used in the constituent layers of the heat transfer dye-providing heat transfer material and image-receiving material. Such surface active agents can aid coating, improve the peeling property, improve the sliding property, prevent static, and develop acceleration.

An organic fluoro compound may also be incorporated into the constituent layers of the heat transfer dye-providing heat transfer material and image-receiving material, to improve the sliding property, to prevent static, and to improve the peeling property.

A matting agent can also be used in the heat transfer dye-providing heat transfer material and image-receiving material.

In the present invention, the heat transfer dye-providing heat transfer material can be combined with the image-receiving material for printing with various printers of a heat printing system, a facsimile, or a print making of an image by a magnetic recording system, a photoelectro-magnetic recording system, and a photo recording system, and a print making from a television or a CRT display.

The present invention will be explained below in more details with reference to the examples, but the present invention is not limited thereto.

EXAMPLE 1

The following light-sensitive element 1 was prepared as a color diffusion transfer light-sensitive element.

Light-sensitive element 1:

The respective layers were coated as follows on a polyethylene terephthalate transparent support to thereby prepare a light-sensitive sheet.

Back layer: (a) a light shielding layer containing carbon black (4.0 g/m$^2$) and gelatin (2.0 g/m$^2$).

Emulsion layer side:

(1) a layer containing the following cyan dye-releasing redox compound (0.44 g/m$^2$), tricyclohexyl phosphate (0.09 g/m$^2$), 2,5-di-t-pentadecylhydroquinone (0.008 g/m$^2$), and gelatin (0.8 g/m$^2$);

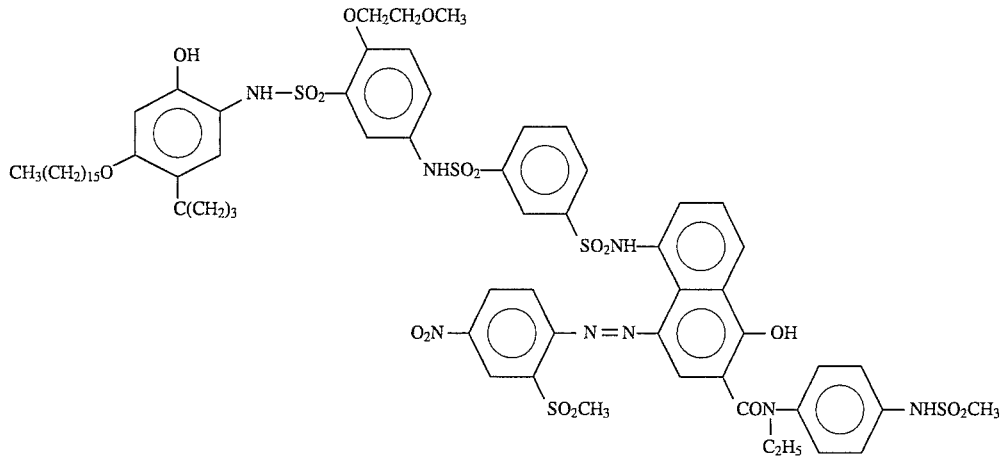

(2) a layer containing gelatin (0.5 g/m$^2$);

(3) a red-sensitive emulsion layer containing a red-sensitive inner latent image type direct positive silver bromide emulsion (0.6 g/m$^2$ in terms of a silver amount ), gelatin (1.2 g/m$^2$), the following nucleus forming agent (0.015 mg/m$^2$), and sodium 2-sulfo-5 -n-pentadecylhydroquinone (0.06 g/m$^2$);

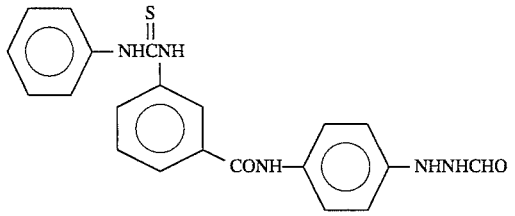

(4) a layer containing 2,5-di-t-pentadecylhydroquinone (0.43 g/m$^2$), trihexyl phosphate (0.1 g/m$^2$), and gelatin (0.4 g/m$^2$);

(5) a layer containing the following magenta dye-releasing redox compound (0.3 g/m$^2$), tricyclohexyl phosphate (0.08 g/m$^2$), 2,5-di-tert-pentadecylhydroquinone (0.009 g/m$^2$), and gelatin (0.5 g/m$^2$);

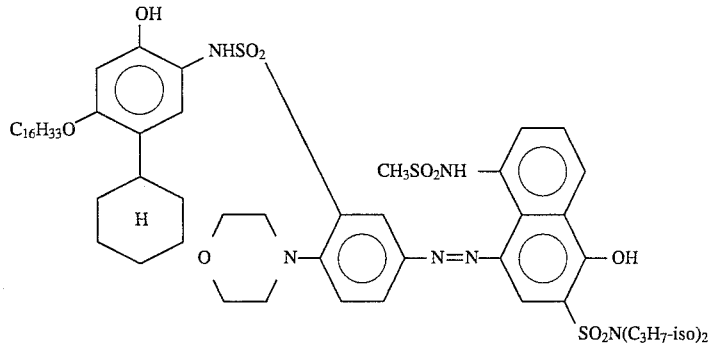

(6) a green-sensitive emulsion layer containing a green-sensitive inner latent image type direct positive silver bromide emulsion (0.42 g/m$^2$ in terms of a silver amount), gelatin (0.9 g/m$^2$), the same nucleus forming agent as that in the layer (3) (0.013 mg/m$^2$), and sodium 2-sulfo-5-n-pentadecylhydroquinone (0.07 g/m$^2$);

(7) the same layer as the layer (4);

(8) a layer containing the following yellow dye-releasing redox compound (0.53 g/m$^2$), tricyclohexyl phosphate (0.13 g/m$^2$), 2,5-di-tert-pentadecylhydroquinone (0.014 g/m$^2$), and gelatin (0.7 g/m$^2$);

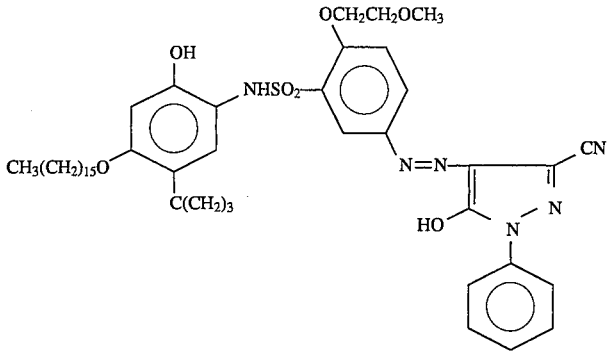

(9) a -blue-sensitive emulsion layer containing a blue-sensitive inner latent image type direct positive silver bromide emulsion (0.6 g/m$^2$ in terms of a silver amount), gelatin (1.1 g/m$^2$), the same nucleus forming agent as that in the layer (3) (0.019 g/m$^2$), and sodium 2-sulfo-5-n-pentadecylhydroquinone (0.05 g/m$^2$);

(10) a layer containing gelatin (1.0 g/m$^2$).

Next, the color diffusion transfer image-receiving element 101 having the constitution shown in Table 1 was prepared as the dye fixing element.

TABLE 1

Constitution of the image-receiving element 101

| Layer No. | Layer name | Additive | Coated amount |
|---|---|---|---|
| F6 layer | Protective layer | Gelatin | 0.6 g/m$^2$ |
| F5 layer | Mordant layer | Formaldehyde | 0.0036 g/m$^2$ |
| | | Gelatin | 3.0 g/m$^2$ |
| | | Formaldehyde | 0.015 g/m$^2$ |
| | | Mordant | 2.0 g/m$^2$ |
| | | Coating aid | 0.005 g/m$^2$ |
| F4 layer | Timing layer (1) | Polymer latex (1) | 0.96 g/m$^2$ |
| | | Polymer latex (2) | 0.64 g/m$^2$ |
| F3 layer | Intermediate layer | Poly(2-hydroxy-ethylmethacrylate) | 0.4 g/m$^2$ |
| F2 layer | Timing layer (2) | Cellulose acetate (acetylation: 51.3%) | 4.27 g/m$^2$ |
| | | Styrene/maleic acid anhydride (mole ratio 1:1) copolymer (average molecular weight: 10,000) | 0.23 g/m$^2$ |
| F1 layer | Neutralizing layer | Acrylic acid/butyl acrylate (average molecular weight: 50,000) (mole ratio 8:2) | 22 g/m$^2$ |
| Paper support (150 μm, polyethylene of 30 μm was laminated on both sides thereof) | | | |
| B1 layer | Light shielding layer | Gelatin | 2.0 g/m$^2$ |
| | | Carbon black | 4.0 g/m$^2$ |
| B2 layer | White color layer | Gelatin | 1.0 g/m$^2$ |
| | | Titanium oxide | 8.0 g/m$^2$ |
| B3 layer | Protective layer | Gelatin | 0.6 g/m$^2$ |

Coating aid

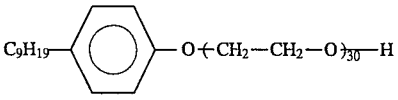

TABLE 1-continued

Constitution of the image-receiving element 101

| Layer No. | Layer name | Additive | Coated amount |
|---|---|---|---|

Mordant

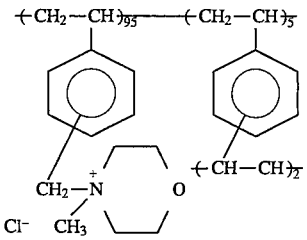

Polymer latex (1):

a polymer latex obtained by emulsion polymerizing styrene, butyl acrylate, acrylic acid and N-methylol-acrylamide in a weight ratio of 49.7:42.3:4:4.

Polymer latex (2):

a polymer latex obtained by emulsion polymerizing methyl methacrylate, acrylic acid and N-methylol-acrylamide in a weight ratio of 93:3:4.

Next, the image-receiving elements 102 to 109 were prepared in the same manner as the above except that the hydrazine derivatives of the present invention were added as shown in Table 2.

TABLE 2

Coated amount of hydrazine derivative of the present invention

| Image-receiving element | Hydrazine derivative | Coated amount (g/m$^2$) |
|---|---|---|
| 102 | Compound (6) | 0.11 |
| 103 | Compound (7) | 0.14 |
| 104 | Compound (12) | 0.21 |
| 105 | Compound (18) | 0.17 |
| 106 | Compound (22) | 0.21 |
| 107 | Compound (31) | 0.25 |
| 108 | Compound (32) | 0.37 |
| 109 | Compound (33) | 0.43 |

Next, the composition of the processing solution is shown below:

| Processing solution | |
|---|---|
| 1-p-Tolyl-4-hydroxymethyl-4-methyl-3-pyrazolidone | 6.9 g |
| Methylhydroquinone | 0.3 g |
| 5-Methylbenzotriazole | 3.5 g |
| Sodium sulfite (anhydrous) | 0.2 g |
| Sodium carboxymethylcellulose | 58 g |
| Potassium hydroxide (28% aqueous solution) | 200 ml |
| Benzyl alcohol | 1.5 ml |
| Water | 835 ml |

After the above light-sensitive element 1 was exposed through a color test chart, each of the dye fixing elements 101 to 109 was superposed thereon and the following processing solution was spread between the light-sensitive element 1 and the dye fixing element so that the thickness thereof was 60μ (it was spread with an aid of a pressurized roller).

The processing was carried out at 25° C. for 90 seconds. After finishing the processing, the light-sensitive element and each dye fixing element (101 to 109) were separated to allow them to stand for drying.

Evaluating method of a light fastness (a fading test)

The reflection density of a dye image transferred to each of the dye fixing elements was measured with a densitometer X-Rite 310 type. A light released from a xenon lump was irradiated to each of the dye fixing elements, and the reflection density of a dye image on the dye fixing element was measured after 7 days to obtain the residual rate of the dye at a portion of the density 1.0 before the irradiation. The results are shown in Table 3.

Residual rate of dye=[Reflection density after light irradiation÷Reflection density before light irradiation]×100

TABLE 3

| Light fastness of a transferred dye | | | |
|---|---|---|---|
| | Residual rate of dye | | |
| Image-receiving element | Yellow | Magenta | Cyan |
| 101 (Comparison) | 69 | 48 | 21 |
| 102 (Invention) | 72 | 65 | 42 |
| 103 (Invention) | 70 | 65 | 45 |
| 104 (Invention) | 71 | 63 | 42 |
| 105 (Invention) | 73 | 70 | 55 |
| 106 (Invention) | 76 | 72 | 57 |
| 107 (Invention) | 74 | 81 | 72 |
| 108 (Invention) | 77 | 85 | 76 |
| 109 (Invention) | 78 | 83 | 75 |

It can be found from the results shown in Table 3 that the image-receiving elements (102 to 109) which are the dye fixing elements of the present invention have an excellent light fastness of the transferred dye compared with that of the comparative image-receiving element (101).

EXAMPLE 2

(Heat developing color diffusion transfer process)

A preparation method for a dispersion of zinc hydroxide will be described.

Zinc hydroxide (12.5 g) with an average particle size of 0.2 μm, carboxymethylcellulose (1 g) as a dispersant, and poly(sodium acrylate) (0.1 g) were added to a 4% gelatin aqueous solution (100 ml) and pulverized for 30 minutes with a mill using glass beads having an average particle size of 0.75 mm. The glass beads were separated to obtain the dispersion of zinc hydroxide.

Next, a preparing method for a dispersion of an electron transfer agent will be described.

An electron transfer agent A (10 g), polyethylene glycol nonylphenyl ether (0.5 g) as a dispersant, and an anionic surface active agent A (0.5 g) were added to a 5% gelatin aqueous solution and pulverized for 60 minutes with a mill using glass beads having an average particle size of 0.75 mm. The glass beads were separated to obtain the dispersion of the electron transfer agent with an average particle size of 0.4 μm.

Electron transfer agent A

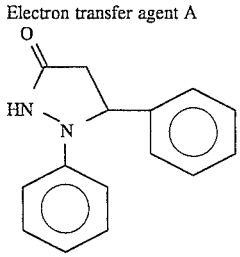

Anionic surface active agent A

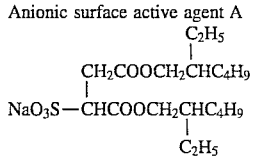

Next, a method for preparing a dispersion of a dye trapping agent will be described.

A mixed solution of a polymer latex A (a solid content: 13%) (108 ml), a surface active agent B (20 g), and water (1232 ml) was added to a 5% aqueous solution (600 ml) of an anionic surface active agent C over a period of 10 minutes while stirring. The dispersion thus prepared was concentrated to 500 ml and desalted with a ultrafiltration module. Then, water (1500 ml) was added and the same procedure was repeated once again, whereby the dispersion (500 g) of the dye trapping agent was obtained.

Polymer latex A

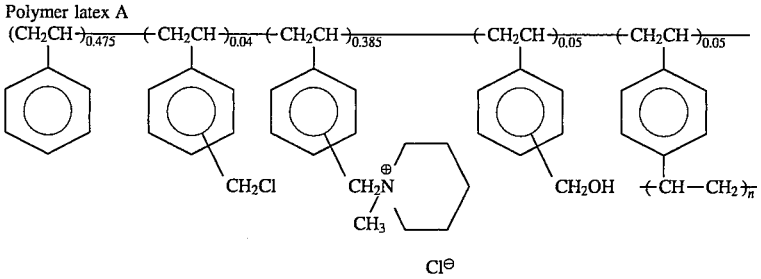

Surface active agent B

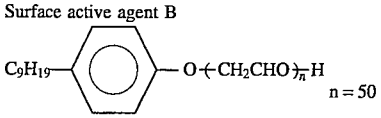

Anionic surface active agent C

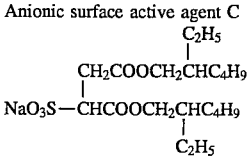

Next, a method for preparing a gelatin dispersion of a hydrophobic additive will be described.

The gelatin dispersions of the cyan, magenta and yellow dye-providing materials and an electron donating material were prepared according to the procedures shown in Table 4, respectively. That is, each of the oil phase components was heated to about 60° C. and dissolved to prepare a uniform solution. To this solution an aqueous phase component heated to about 60° C. was added, stirred, mixed, and then was dispersed with a homogenizer at 10000 rpm for 10 minutes. Water was added and stirred to obtain a uniform dispersion.

TABLE 4

| | Cyan | Magenta | Yellow | EDM* |
|---|---|---|---|---|
| Oil phase | | | | |
| Dye-providing material (1) | 11.31 g | — | — | — |
| Dye-providing material (2) | 3.87 g | — | — | — |
| Dye-providing material (3) | — | 15.5 g | — | — |
| Dye-providing material (4) | — | — | 13.0 g | — |
| Electron donating material (1) | 5.38 g | 5.61 g | 6.47 g | — |
| Electron donating material (2) | — | — | — | 12.68 g |
| Inhibitor-releasing redox compound (1) | — | — | — | 2.63 g |
| Electron transfer precursor | 1.42 g | 1.42 g | 0.86 g | — |
| Compound (1) | 0.46 g | 0.56 g | 0.64 g | — |
| Compound (2) | — | — | — | 0.82 g |
| High boiling solvent (1) | 3.80 g | 3.88 g | 5.20 g | 5.10 g |
| High boiling solvent (2) | — | — | 3.90 ml | — |
| Surface active agent (1) | 3.80 g | 3.88 g | — | — |
| Surface active agent (2) | — | — | 1.50 g | 0.45 g |
| Ethyl acetate | — | — | 37.0 ml | 23.8 ml |
| Methyl ethyl ketone | 74.0 ml | 74.0 ml | — | — |
| Cyclohexanone | — | — | — | 1.85 ml |
| Aqueous phase | | | | |
| Lime-treated gelatin | 10.0 g | 10.0 g | 10.0 g | 10.0 g |
| Citric acid | — | — | 0.20 g | 0.06 g |
| Sodium bisulfite | — | — | — | 0.15 g |
| Water | 230 ml | 230 ml | 150 ml | 63.0 ml |
| Water | 92.0 ml | 92.0 ml | 100 ml | 90.0 ml |

*Electron donating material

Dye-providing compound (1)

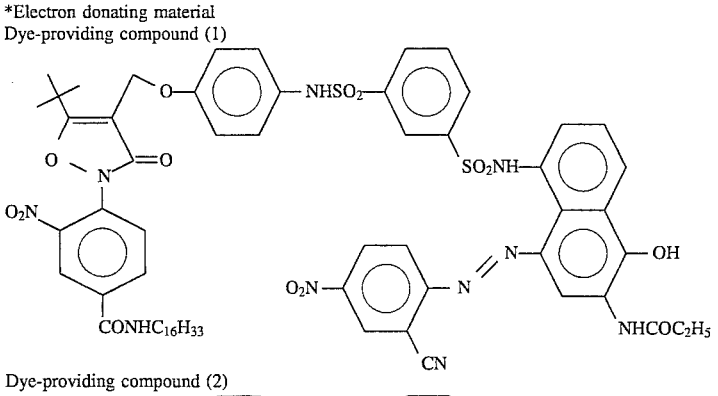

Dye-providing compound (2)

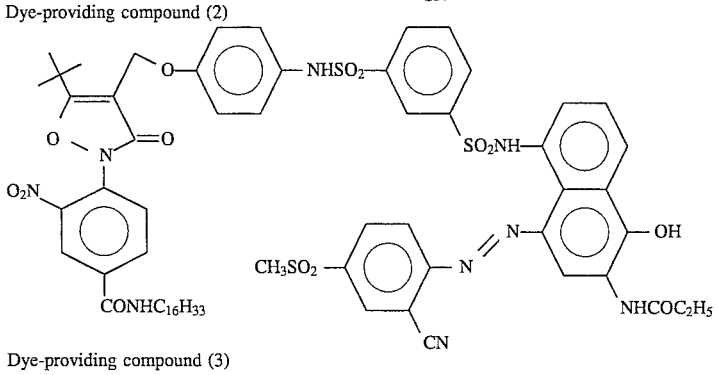

Dye-providing compound (3)

TABLE 4-continued
| | Cyan | Magenta | Yellow | EDM* |
|---|---|---|---|---|
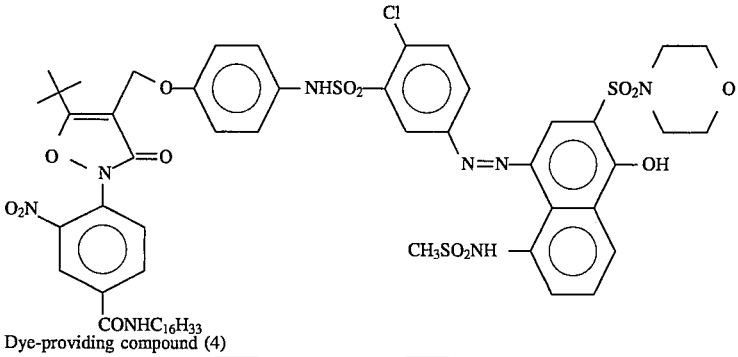
Dye-providing compound (4)
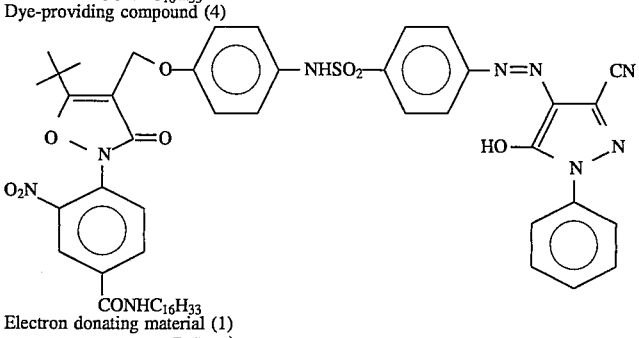
Electron donating material (1)
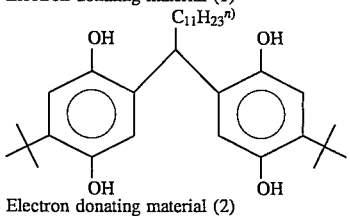
Electron donating material (2)
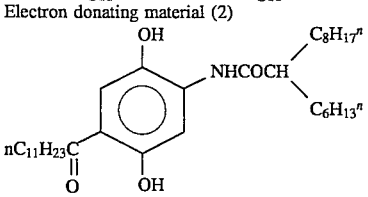
Inhibitor-releasing redox compound (1)
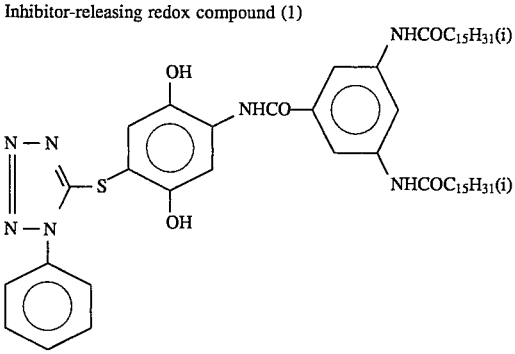
Electron transfer agent precursor TABLE 4-continued

| | Cyan | Magenta | Yellow | EDM* |
|---|---|---|---|---|

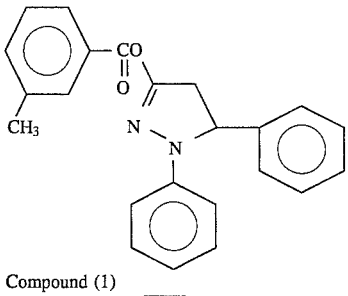

Compound (1)

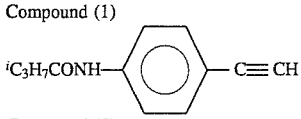

Compound (2)

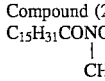

High boiling solvent (1)

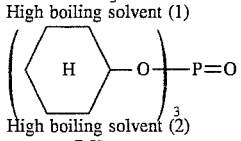

High boiling solvent (2)

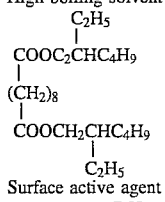

Surface active agent (1)

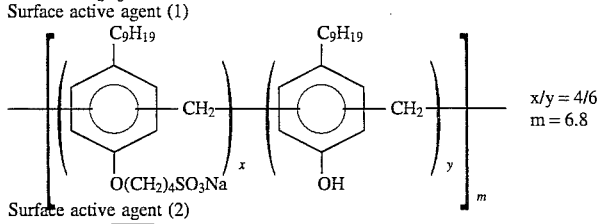

x/y = 4/6
m = 6.8

Surface active agent (2)

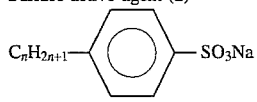

n ≈ 12.6

Next, a method for preparing a light-sensitive emulsion is described below.

Light-sensitive silver halide emulsion (1) (for a red-sensitive emulsion layer)

A solution (I) and a solution (II) each shown in Table 5, were simultaneously added to a gelatin aqueous solution (gelatin 20 g, potassium bromide 0.5 g, sodium chloride 3 g and a chemical (A) 30 mg were added to water 480 ml and maintained at a temperature of 45° C.) in the same flowing amount over a period of 20 minutes while vigorously stirring. Further, five minutes later solution (III) and solution (IV), each shown in Table 5, were simultaneously added in the same flowing amount over a period of 25 minutes. Ten minutes after the first addition of the solution (III) and solution (IV), an aqueous solution of a gelatin dispersion of a dye (gelatin 1 g, a dye (a) 67 mg, a dye (b) 133 mg and a dye (c) 4 mg were added to water 105 ml and maintained at a temperature of 45° C.) was added over a period of 20 minutes.

After the emulsion was subjected to washing and desalting by an ordinary method, lime-treated ossein gelatin (22 g) was added and pH and pAg were adjusted to 6.2 and 7.7, respectively, followed by adding sodium thiosulfate, 4-hydroxy-6-methyl-1,3,3a,7-tetrazaindene and chloroauric acid to provide an optimum chemical sensitization at 60° C., whereby a monodispersed cubic silver chlorobromide emulsion (635 g) having an average grain size of 0.30 μm was obtained.

TABLE 5

Chemical (A)

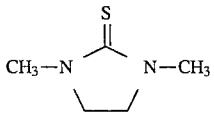

| | Solution | | | |
|---|---|---|---|---|
| | (I) | (II) | (III) | (IV) |
| $AgNO_3$ | 50.0 g | — | 50.0 g | — |

TABLE 5-continued

Chemical (A)

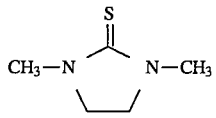

| | Solution | | | |
|---|---|---|---|---|
| | (I) | (II) | (III) | (IV) |
| $NH_4NO_3$ | 0.19 g | — | 0.19 g | — |
| KBr | — | 28.0 g | — | 35.0 g |
| NaCl | — | 3.45 g | — | — |
| Water to make | 250 ml | 250 ml | 200 ml | 200 ml |

Dye (a)

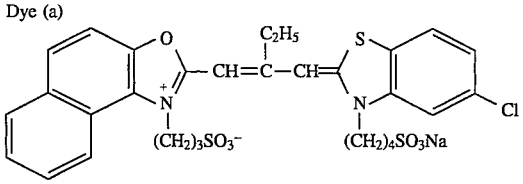

Dye (b)

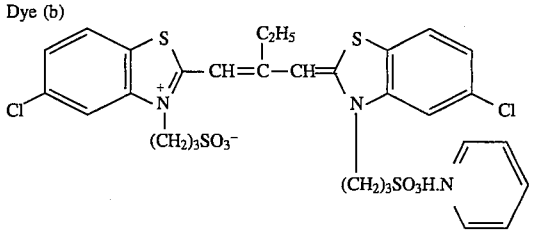

Dye (c)

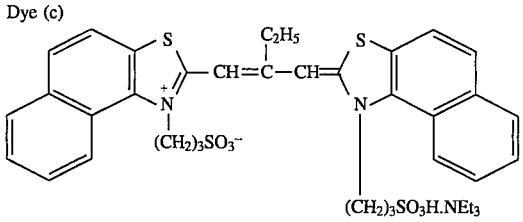

Et is an ethyl group.

Light-sensitive silver halide emulsion (2) (for a red-sensitive emulsion layer)

A solution (I) and a solution (II), each shown in Table 6, were simultaneously added to a gelatin aqueous solution (gelatin 20 g, potassium bromide 0.5 g, sodium chloride 6 g and the above chemical (A) 30 mg were added to water 783 ml and maintained at a temperature of 65° C.) in the same flowing amount over a period of 30 minutes while vigorously stirring. Further, five minutes later a solution (III) and a solution (IV), each shown in Table 6, were simultaneously added into the same flowing amount over a period of 15 minutes. Two minutes after the first addition of the solution (III) and solution (IV), an aqueous solution of a gelatin dispersion of a dye (gelatin 0.9 g, a dye (a) 61 mg, a dye (b) 121 mg and a dye (c) 4 mg were added to water 95 ml and maintained at a temperature of 50° C.) was added over a period of 18 minutes.

After the emulsion was subjected to washing and desalting by an ordinary method, lime-treated ossein gelatin (22 g) was added and pH and pAg were adjusted to 6.2 and 7.7, respectively, followed by adding sodium thiosulfate, 4-hydroxy-6-methyl-1,3,3a,7-tetrazaindene and chloroauric acid to provide an optimum chemical sensitization at 60° C., whereby a monodispersed cubic silver chlorobromide emulsion (635 g) having an average grain size of 0.50 μm was obtained.

TABLE 6

| | Solution | | | |
|---|---|---|---|---|
| | (I) | (II) | (III) | (IV) |
| $AgNO_3$ | 50.0 g | — | 50.0 g | — |
| $NH_4NO_3$ | 0.19 g | — | 0.19 g | — |
| KBr | — | 28.0 g | — | 35.0 g |
| NaCl | — | 3.45 g | — | — |
| Water to make | 200 ml | 140 ml | 145 ml | 155 ml |

Light-sensitive silver halide emulsion (3) (for a green-sensitive emulsion layer)

A solution (I) and a solution (II), each shown in Table 7, were simultaneously added to a gelatin aqueous solution (gelatin 20 g, potassium bromide 0.5 g, sodium chloride 4 g and the chemical (A) 15 mg were added to water 675 ml and maintained at a temperature of 48° C.) in the same flowing amount over a period of 10 minutes while vigorously stirring. Further, ten minutes later a solution (III) and a solution (IV), each shown in Table 7, were simultaneously added in the same flowing amount over a period of 20 minutes. One minute after the last addition of the solution (III) and solution (IV), an aqueous solution of a gelatin dispersion of a dye (gelatin 3.0 g and a dye (d) 300 mg were added to water 120 ml and maintained at a temperature of 45° C.) was added in one lump.

After the emulsion was subjected to washing and desalting by an ordinary method, lime-treated ossein gelatin (20 g) was added and pH and pAg were adjusted to 6.0 and 7.6, respectively, followed by adding sodium thiosulfate, 4-hydroxy-6-methyl-1,3,3a,7-tetrazaindene and chloroauric acid to provide an optimum chemical sensitization at 68° C., whereby a monodispersed cubic silver chlorobromide emulsion (635 g) having an average grain size of 0.27 μm was obtained.

TABLE 7

| | Solution | | | |
|---|---|---|---|---|
| | (I) | (II) | (III) | (IV) |
| $AgNO_3$ | 50.0 g | — | 50.0 g | — |
| $NH_4NO_3$ | 0.25 g | — | 0.25 g | — |
| KBr | — | 21.0 g | — | 28.0 g |
| NaCl | — | 6.90 g | — | 3.45 g |
| Water to make | 200 ml | 150 ml | 200 ml | 150 ml |

Dye (d)

TABLE 7-continued

| | Solution | | | |
|---|---|---|---|---|
| | (I) | (II) | (III) | (IV) |

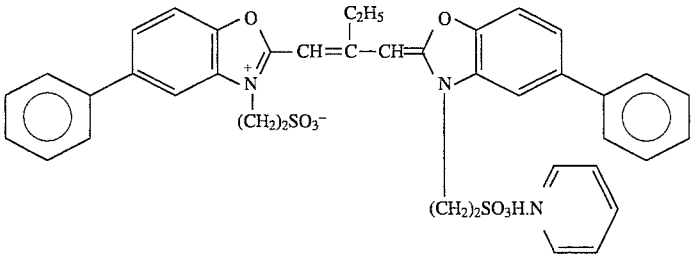

Light-sensitive silver halide emulsion (4) (for a green-sensitive emulsion layer)

A solution (I) and a solution (II) each shown in Table 8, were simultaneously added to a gelatin aqueous solution (gelatin 20 g, potassium bromide 0.3 g, sodium chloride 6 g and the chemical (A) 15 mg were added to water 675 ml and maintained at a temperature of 55° C.) in the same flowing amount over a period of 20 minutes while vigorously stirring. Further, ten minutes later a solution (III) and a solution (IV), each shown in Table 8, were simultaneously added in the same flowing amount over a period of 20 minutes. One minute after the last addition of the solution (III) and solution (IV), an aqueous solution of a gelatin dispersion of a dye (gelatin 2.5 g and a dye (d) 250 mg were added to water 95 ml and maintained at a temperature of 45° C.) was added in one lump.

After the emulsion was subjected to washing and desalting by an ordinary method, lime-treated ossein gelatin (20 g) was added and pH and pAg were adjusted to 6.0 and 7.6, respectively, followed by adding sodium thiosulfate, 4-hydroxy-6-methyl-1,3,3a,7-tetrazaindene and chloroauric acid to provide an optimum chemical sensitization at 68° C. whereby a monodispersed cubic silver chlorobromide emulsion (635 g) having an average grain size of 0.42 μm was obtained.

TABLE 8

| | Solution | | | |
|---|---|---|---|---|
| | (I) | (II) | (III) | (IV) |
| $AgNO_3$ | 50.0 g | — | 50.0 g | — |
| $NH_4NO_3$ | 0.25 g | — | 0.25 g | — |
| KBr | — | 28.0 g | — | 35.0 g |
| NaCl | — | 3.45 g | — | — |
| Water to make | 200 ml | 200 ml | 150 ml | 150 ml |

Light-sensitive silver halide emulsion (5) (for a blue-sensitive emulsion layer)

A solution (I) and a solution (II), each shown in Table 9, were simultaneously added to a gelatin aqueous solution (gelatin 20 g, potassium bromide 0.5 g, sodium chloride 4 g and the chemical (A) 15 mg were added to water 675 ml and maintained at a temperature of 50° C.) in the same flowing amount over a period of 8 minutes while vigorously stirring. Further, ten minutes later a solution (III) and a solution (IV), each shown in Table 9, were simultaneously added in the same flowing amount over a period of 32 minutes. One minute after the last addition of the solution (III) and solution (IV), an aqueous solution of a gelatin dispersion of a dye (a dye (e) 220 mg and a dye (f) 110 mg were added to water 95 ml and methanol 5 ml and maintained at a temperature of 45° C.) was added in one lump.

After the emulsion was subjected to washing and desalting by an ordinary method, lime-treated ossein gelatin (22 g) was added and pH and pAg were adjusted to 6.0 and 7.8, respectively, followed by adding sodium thiosulfate and 4-hydroxy-6-methyl-1,3,3a,7-tetrazaindene to provide an optimum chemical sensitization at 68° C., whereby a monodispersed cubic silver chlorobromide emulsion (635 g) having an average grain size of 0.30 μm was obtained.

TABLE 9

| | Solution | | | |
|---|---|---|---|---|
| | (I) | (II) | (III) | (IV) |
| $AgNO_3$ | 20.0 g | — | 80.0 g | — |
| $NH_4NO_3$ | 0.10 g | — | 0.40 g | — |
| KBr | — | 9.8 g | — | 44.8 g |
| NaCl | — | 2.60 g | — | 5.52 g |
| Water to make | 80 ml | 80 ml | 240 ml | 240 ml |

Dye (e)

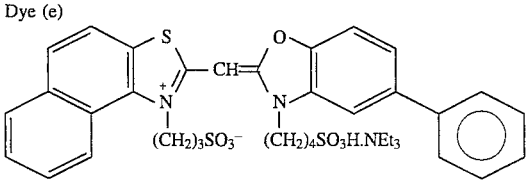

Dye (f)

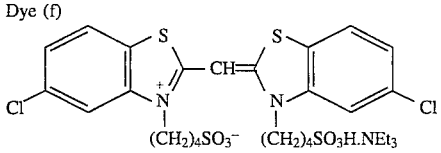

Light-sensitive silver halide emulsion (6) (for a blue-sensitive emulsion layer)

A solution (I) and a solution (II), each shown in Table 10, were simultaneously added to a gelatin aqueous solution (gelatin 20 g, potassium bromide 0.3 g, sodium chloride 9 g and the chemical (A) 15 mg were added to water 675 ml and maintained at a temperature of 65° C.) in the same flowing amount over a period of 10 minutes while vigorously stirring. Ten minutes later, a solution (III) and a solution (IV), each shown in Table 10, were simultaneously added in the same flowing amount over a period of 30 minutes. One minute after the last addition of the solution (III) and solution (IV), an aqueous solution of a gelatin dispersion of a dye (a dye (e) 150 mg and a dye (f) 75 mg were added to water 66 ml and methanol 4 ml and maintained at a temperature of 60° C.) was added in one lump.

After the emulsion was subjected to washing and desalting by an ordinary method, lime-treated ossein gelatin 22 g was added and pH and pAg were adjusted to 6.0 and 7.8, respectively, followed by adding sodium thiosulfate, 4-hydroxy-6-methyl-1,3,3a,7-tetrazaindene and chloroauric acid to provide an optimum chemical sensitization at 68° C., whereby a monodispersed cubic silver chlorobromide emulsion (635 g) having an average grain size of 0.55 μm was obtained.

TABLE 10

| | Solution | | | |
|---|---|---|---|---|
| | (I) | (II) | (III) | (IV) |
| $AgNO_3$ | 25.0 g | — | 75.0 g | — |
| $NH_4NO_3$ | 0.13 g | — | 0.37 g | — |
| KBr | — | 12.3 g | — | 42.0 g |
| NaCl | — | 2.58 g | — | 5.18 g |
| Water to make | 100 ml | 100 ml | 225 ml | 225 ml |

The above materials were used to prepare the light-sensitive element 2 shown in Table A.

TABLE A

Constituent parts of the light-sensitive material 101

| Layer No. | Layer name | Additive | Coated amount |
|---|---|---|---|
| 7th layer | Protective layer II | Gelatin | 440 mg/m$^2$ |
| | | Silica (size: 4μ) | 40 mg/m$^2$ |
| | | Zinc hydroxide | 570 mg/m$^2$ |
| | | Colloidal silver | 1 mg/m$^2$ |
| | | Surface active agent (3) | 16 mg/m$^2$ |
| | | Dextran | 25 mg/m$^2$ |
| | | Water soluble polymer (1) | 2 mg/m$^2$ |
| 6th layer | Protective layer I | Gelatin | 224 mg/m$^2$ |
| | | Zinc hydroxide | 165 mg/m$^2$ |
| | | Electron donating material (2) | 60 mg/m$^2$ |
| | | Inhibitor-releasing redox compound (1) | 11 mg/m$^2$ |
| | | Compound (2) | 4.7 mg/m$^2$ |
| | | High boiling solvent (3) | 21 mg/m$^2$ |
| | | Surface active agent (3) | 3.6 mg/m$^2$ |
| | | Dextran | 13 mg/m$^2$ |
| | | Water soluble polymer (1) | 1.4 mg/m$^2$ |
| | | Polymer latex (1) | 22 mg/m$^2$ |
| | | Surface active agent (4) | 5 mg/m$^2$ |
| | | Surface active agent (5) | 8.4 mg/m$^2$ |
| 5th layer | Blue-sensitive emulsion layer | Light-sensitive silver halide emulsion (5) | 360 mg/m$^2$* |
| | | Light-sensitive silver halide emulsion (6) | 105 mg/m$^2$* |
| | | Dye-providing material (4) | 429 mg/m$^2$ |
| | | Gelatin | 560 mg/m$^2$ |
| | | Electron donating material (1) | 213 mg/m$^2$ |
| | | Electron transfer agent precursor | 28 mg/m$^2$ |
| | | Compound (1) | 21 mg/m$^2$ |
| | | High boiling solvent (1) | 172 mg/m$^2$ |
| | | High boiling solvent (2) | 120 mg/m$^2$ |
| | | Surface active agent (2) | 49 mg/m$^2$ |
| | | Anti-fogging agent (1) | 1.2 mg/m$^2$ |
| | | Water soluble polymer (1) | 2 mg/m$^2$ |
| 4th layer | Intermediate layer | Gelatin | 540 mg/m$^2$ |
| | | Electron donating material (2) | 173 mg/m$^2$ |
| | | Inhibitor-releasing redox compound (1) | 31 mg/m$^2$ |
| | | Compound (2) | 13 mg/m$^2$ |
| | | High boiling solvent (3) | 67 mg/m$^2$ |
| | | Surface active agent (2) | 5.3 mg/m$^2$ |
| | | Surface active agent (3) | 10 mg/m$^2$ |
| | | Electron transfer agent | 78 mg/m$^2$ |
| | | Dextran | 37 mg/m$^2$ |
| | | Hardener (1) | 31 mg/m$^2$ |
| | | Hardener (2) | 10 mg/m$^2$ |
| | | Water soluble polymer (1) | 10 mg/m$^2$ |
| 3rd layer | Green-sensitive emulsion layer | Light-sensitive silver halide emulsion (3) | 232 mg/m$^2$* |
| | | Light-sensitive silver halide emulsion (4) | 66 mg/m$^2$* |
| | | Dye-providing material (3) | 363 mg/m$^2$ |
| | | Gelatin | 380 mg/m$^2$ |
| | | Electron donating material (1) | 131 mg/m$^2$ |
| | | Electron transfer agent precursor | 33 mg/m$^2$ |
| | | Compound (1) | 13 mg/m$^2$ |
| | | High boiling solvent (1) | 145 mg/m$^2$ |
| | | High boiling solvent (3) | 36 mg/m$^2$ |
| | | Anti-fogging agent (1) | 1.5 mg/m$^2$ |
| | | Water soluble polymer (1) | 10 mg/m$^2$ |
| | | Surface active agent (2) | 6 mg/m$^2$ |
| 2nd layer | Intermediate | Gelatin | 637 mg/m$^2$ |

TABLE A-continued

| Constituent parts of the light-sensitive material 101 | | | |
|---|---|---|---|
| | layer | Zinc hydroxide | 467 mg/m$^2$ |
| | | Electron donating material (2) | 170 mg/m$^2$ |
| | | Inhibitor-releasing redox compound (1) | 31 mg/m$^2$ |
| | | Compound (2) | 13 mg/m$^2$ |
| | | High boiling solvent (1) | 67 mg/m$^2$ |
| | | Surface active agent (2) | 5.3 mg/m$^2$ |
| | | Surface active agent (3) | 10 mg/m$^2$ |
| | | Dextran | 37 mg/m 2 |
| | | Water soluble polymer (1) | 4.0 mg/m$^2$ |
| | | Polymer latex (1) | 63 mg/m$^2$ |
| | | Surface active agent (4) | 14 mg/m$^2$ |
| | | Surface active agent (5) | 24 mg/m$^2$ |
| 1st layer | Red-sensitive emulsion layer | Light-sensitive silver halide emulsion (1) | 158 mg/m$^2$* |
| | | Light-sensitive silver halide emulsion (2) | 64 mg/m$^2$* |
| | | Dye-providing material (1) | 193 mg/m$^2$ |
| | | Dye-providing material (2) | 132 mg/m$^2$ |
| | | Gelatin | 326 mg/m$^2$ |
| | | Electron donating material (1) | 115 mg/m$^2$ |
| | | Electron transfer agent precursor | 30 mg/m$^2$ |
| | | Compound (1) | 9.8 mg/m$^2$ |
| | | High boiling solvent (1) | 130 mg/m$^2$ |
| | | High boiling solvent (3) | 32 mg/m$^2$ |
| | | Surface active agent (3) | 1.0 mg/m$^2$ |
| | | Anti-fogging agent (1) | 0.8 mg/m$^2$ |
| | | Water soluble polymer (1) | 15 mg/m$^2$ |
| | | Surface active agent (2) | 32 mg/m$^2$ |

Support (1) Paper support laminated with polyethylene (thickness: 143 μm)
*Amount converted to silver Support (1)

| Layer name | Composition | Layer thickness (μm) |
|---|---|---|
| Surface subbing layer | Gelatin | 0.1 |
| Surface PE layer | Low density polyethylene (density 0.923): 89.2 parts, | 45.0 |
| | Surface-treated titanium oxide: 10.0 parts, | |
| (glossy) | Ultramarine: 0.8 parts | |
| Pulp layer | Wood free paper (LBKP/NBKP = 1/1, density: 1.080) | 62.0 |
| Back face PE layer (mat) | High density polyethylene (density: 0.960) | 36.0 |
| Back face subbing layer | Gelatin | 0.05 |
| | Colloidal silica | 0.05 |
| | | 143.2 |

Surface active agent (3)

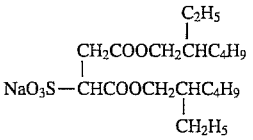

Surface active agent (4)

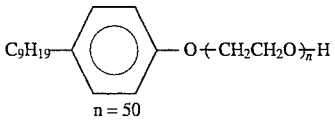

n = 50

Surface active agent (5)

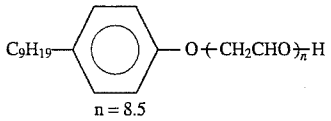

n = 8.5

Anti-fogging agent (1)

TABLE A-continued

Constituent parts of the light-sensitive material 101

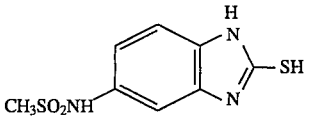

Anti-fogging agent (2)

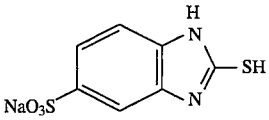

Water soluble polymer (1)

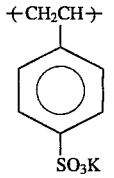

Polymer latex (1)

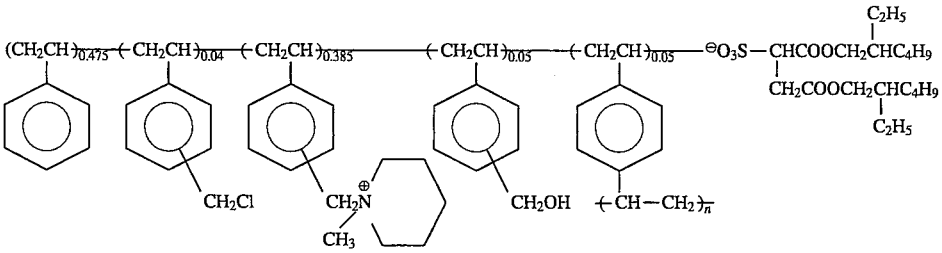

Hardener (1)

$CH_2{=}CHSO_2CH_2CONH(CH_2)_2NHCOCH_2SO_2CH{=}CH_2$

Hardener (2)

$CH_2{=}CHSO_2CH_2CONH(CH_2)_3NHCOCH_2SO_2CH{=}CH_2$

High boiling solvent (3)

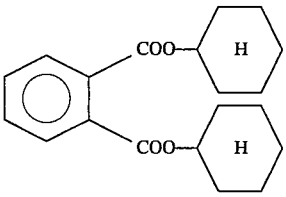

Next, a method for preparing the image-receiving element will be described.

The image-receiving element 201 shown in Table B was prepared.

TABLE B

Constituent parts of the image-receiving material 101

| Layer No. | Additive | Coated amount |
|---|---|---|
| 3rd layer | Carrageenan | 58 mg/m$^2$ |
| | Water soluble polymer (2) | 239 mg/m$^2$ |
| | Guanidine picolinate | 450 mg/m$^2$ |
| | Surface active agent (3) | 10 mg/m$^2$ |
| | Surface active agent (6) | 26 mg/m$^2$ |
| | Surface active agent (7) | 100 mg/m$^2$ |
| 2nd layer | Gelatin | 1360 mg/m$^2$ |
| | High boiling solvent (3) | 1330 mg/m$^2$ |

TABLE B-continued

| Constituent parts of the image-receiving material 101 | | |
|---|---|---|
| | Fluorescent whitening agent | 53 mg/m$^2$ |
| | Compound (3) | 63 mg/m$^2$ |
| | Surface active agent (1) | 17 mg/m$^2$ |
| | Surface active agent (2) | 23 mg/m$^2$ |
| | Mordant | 2350 mg/m$^2$ |
| | Dextran | 610 mg/m$^2$ |
| | Water soluble polymer (2) | 210 mg/m$^2$ |
| | Guanidine picolinate | 2360 mg/m$^2$ |
| 1st layer | Gelatin | 490 mg/m$^2$ |
| | Water soluble polymer (2) | 40 mg/m$^2$ |
| | Surface active agent (7) | 11 mg/m$^2$ |
| | Hardener (3) | 340 mg/m$^2$ |
| Support (2) Paper support laminated with polyethylene (thickness: 164 μm) | | |
| Back | Gelatin | 2950 mg/m$^2$ |
| 1st layer | Water soluble polymer (1) | 40 mg/m$^2$ |
| | Hardener (3) | 125 mg/m$^2$ |
| Back | Gelatin | 430 mg/m$^2$ |
| 2nd layer | Surface active agent (3) | 45 mg/m$^2$ |
| | Surface active agent (8) | 10 mg/m$^2$ |
| | Water soluble polymer (1) | 3 mg/m$^2$ |
| | Matting agent | 30 mg/m$^2$ |

Support (2)

| Layer name | Composition | Layer thickness (μm) |
|---|---|---|
| Surface subbing layer | Gelatin | 0.1 |
| Surface PE layer (glossy) | Low density polyethylene (density 0.923): 89.2 parts, Surface-treated titanium oxide: 10.0 parts, Ultramarine: 0.8 parts | 45.0 |
| Pulp layer | Woodfree paper (LBKP/NBKP = 1/1, density: 1.080) | 82.6 |
| Back face PE layer (mat) | High density polyethylene (density: 0.960) | 36.0 |
| Back face subbing layer | Gelatin | 0.05 |
| | Colloidal silica | 0.05 |
| | | 163.8 |

Water soluble polymer (2)

Sumika Gel L5-H
(manufactured by Sumitomo Chemical Co., Ltd.)

Surface active agent (6)

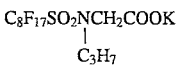

Surface active agent (7)

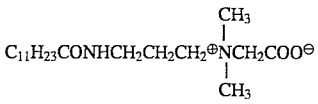

Surface active agent (8)

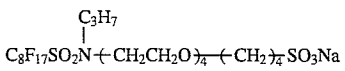

High boiling solvent (3)

$C_{26}H_{46.9}Cl_{7.1}$

Fluorescent whitening agent

TABLE B-continued

Constituent parts of the image-receiving material 101

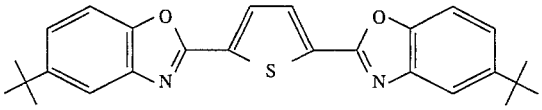

Compound (3)

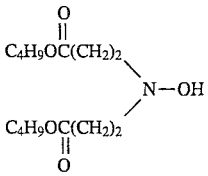

Mordant

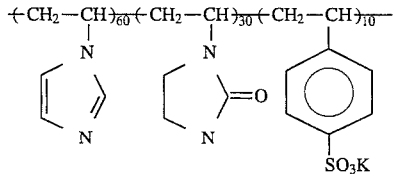

Hardener (3)

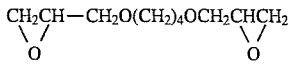

Matting agent

Benzoguamamine resin
(an average particle size: 15 μm)

The image-receiving elements 202 to 209 were prepared in the same manner as the image-receiving element 201 except that the hydrazine derivatives of the present invention were added to the second layer as shown in Table 16.

TABLE 16

| Coated amount of hydrazine derivative of the present invention | | |
|---|---|---|
| Image-receiving element | Hydrazine derivative | Coated amount (g/m$^2$) |
| 202 | Compound (6) | 0.22 |
| 203 | Compound (7) | 0.28 |
| 204 | Compound (12) | 0.42 |
| 205 | Compound (18) | 0.34 |
| 206 | Compound (22) | 0.42 |
| 207 | Compound (31) | 0.50 |
| 208 | Compound (32) | 0.74 |
| 209 | Compound (33) | 0.86 |

The above light-sensitive element 2 and image-receiving elements 201 to 209 were used for carrying out a processing with an image recording equipment described in JP-A-63-137104.

That is, the light-sensitive element was subjected to scanning exposure via an original picture (a test chart on which the wedges of Y, M, Cy and grey having the densities continuously changing are recorded) through a slit. After the light-sensitive element thus exposed was dipped in water maintained at 40° C. for 4 seconds, it was squeezed with rollers and immediately superposed on the image-receiving element so that the layer faces were contacted. Then, heat was applied for seconds with a heat drum was adjusted to emit a temperature so that the temperature of the wet faces absorbing water was 80° C. The light-sensitive element was peeled off from the image-receiving element, whereby a sharp color image corresponding to the original picture was obtained on the image-receiving element.

The image-receiving elements 201 to 209 were subjected to the evaluation of the light fastness in the same manner as in Example 1. The results are shown in Table 17.

TABLE 17

| Light fastness of a transferred dye | | | |
|---|---|---|---|
| | Residual rate of dye | | |
| Image-receiving element | Yellow | Magenta | Cyan |
| 201 (Comparison) | 70 | 61 | 57 |
| 202 (Invention) | 72 | 68 | 65 |
| 203 (Invention) | 71 | 70 | 68 |
| 204 (Invention) | 73 | 67 | 65 |
| 205 (Invention) | 75 | 75 | 70 |
| 206 (Invention) | 74 | 81 | 75 |
| 207 (Invention) | 77 | 85 | 81 |
| 208 (Invention) | 79 | 84 | 80 |
| 209 (Invention) | 78 | 89 | 82 |

The results in Table 17 show that the image-receiving elements 202 to 209, which are the dye fixing elements of the present invention, have excellent light fastness of the transferred dye compared with that of the comparative image-receiving element 201.

EXAMPLE 3

(Heat developing color diffusion transfer process)

A method for preparing the silver halide emulsion (I) for the third layer and first layer will be described.

An aqueous solution (600 ml) containing sodium chloride and potassium bromide and a silver nitrate aqueous solution (silver nitrate 0.59 mole was dissolved in water 600 ml) was simultaneously added to a gelatin aqueous solution (gelatin 20 g and sodium chloride 3 g were added to water 1000 ml and maintained at a temperature of 75° C.) in the same flowing amount over a period of 40 minutes, whereby a monodispersed cubic silver chlorobromide emulsion (bromine: 50 mole %) having an average grain size of 0.40 μm was prepared.

After the emulsion was subjected to washing and desalting, sodium thiosulfate (5 mg) and 4-hydroxy-6 -methyl-1, 3,3a,7-tetrazaindene (20 mg) were added to provide a chemical sensitization at 60° C. The yield of the emulsion was 600 g.

Next, a method for preparing the silver halide emulsion (II) for the fifth layer will be described.

An aqueous solution (600 ml) containing sodium chloride and potassium bromide and a silver nitrate aqueous solution (silver nitrate 0.59 mole was dissolved in water 600 ml) was simultaneously added to a gelatin aqueous solution (gelatin 20 g and sodium chloride 3 g were added to water 1000 ml and maintained at a temperature of 75° C.) in the same flowing amount over a period of 40 minutes, whereby a monodispersed cubic silver chlorobromide emulsion (bromine: 80 mole %) having an average grain size of 0.35 μm was prepared.

After the emulsion was subjected to washing and desalting, sodium thiosulfate (5 mg) and 4-hydroxy-6 -methyl-1, 3,3a,7-tetrazaindene (20 mg) were added to provide with a chemical sensitization at 60° C. The yield of the emulsion was600 g.

Next, a method for preparing a gelatin dispersion of zinc hydroxide will be described.

Zinc hydroxide (12.55 g) with an average particle size of 0.25 μm, carboxymethylcellulose (1 g) as a dispersant, and poly(sodium acrylate) (0.1 g) were added to a 4% gelatin aqueous solution (100 ml) and pulverized with a mill for 30 minutes using glass beads having an average particle size of 0.75 mm. The glass beads were separated to obtain the gelatin dispersion of zinc hydroxide.

Next, a method for preparing a gelatin dispersion of a hydrophobic additive will be described. The oil phase components shown in the following table were dissolved in ethyl acetate (50 ml), respectively, to prepare a uniform solution at 60° C. The aqueous phase components heated to 60° C. were added thereto and dispersed with a dissolver having a disperser with a diameter of 8 cm at 5000 rpm for 30 minutes. Water was added thereto and stirred to thereby prepare a uniform dispersion. This is denoted as the gelatin dispersion of the hydrophobic additive.

TABLE 18

| | Dispersion | | |
|---|---|---|---|
| | Cyan | Magenta | Yellow |
| Oil phase | | | |
| Dye-providing material (1) | — | — | 60 g |
| Dye-providing material (2) | — | 60 g | — |
| Dye-providing material (3) | 48 g | — | |
| Dye-providing material (4) | 24 g | — | — |
| Auxiliary developer (5) | 4.8 g | 4.8 g | 4.8 g |
| Anti-fogging agent (6) | 1.2 g | 0.6 g | 0.6 g |
| High boiling solvent (17) | 36 g | 30 g | 29.3 g |
| High boiling solvent (20) | — | — | — |
| Aqueous phase | | | |
| Lime-treated gelatin | 40 g | 40 g | 40 g |
| Surface active agent (18) | 1.5 g | 1.5 g | 6 g |
| Water | 358.5 g | 358.5 g | 354 g |
| Water to make | 992 ml | 921 ml | 748 ml |

The heat developing color light-sensitive element 3 of the multilayer structure shown in Table C was prepared from the above materials and the following respective materials.

TABLE C

| Layer No. | Layer name | Additive | Coated amount |
|---|---|---|---|
| 7th layer | Protective layer | Gelatin | 24 390 mg/m$^2$ |
| | | Water soluble polymer (7) | 4 mg/m$^2$ |
| | | Matting agent (silica) | 40 mg/m$^2$ |
| | | Zinc hydroxide | 480 mg/m$^2$ |

TABLE C-continued

| | | | |
|---|---|---|---|
| | | Surface active agent (8) | 30 mg/m$^2$ |
| | | Surface active agent (9) | 11 mg/m$^2$ |
| 6th layer | Intermediate layer | Gelatin | 760 mg/m$^2$ |
| | | Water soluble polymer (7) | 16 mg/m$^2$ |
| | | Surface active agent (8) | 7 mg/m$^2$ |
| | | Surface active agent (9) | 22 mg/m$^2$ |
| | | Hardener (10) | 50 mg/m$^2$ |
| 5th layer | Blue-sensitive emulsion layer | Gelatin | 280 mg/m$^2$ |
| | | Light-sensitive silver halide emulsion (II) | 200 mg/m$^2$* |
| | | Sensitizing dye (11) | 1.3 mg/m$^2$ |
| | | Anti-fogging agent (14) | 3.3 mg/m$^2$ |
| | | Magenta dye-providing material (2) | 260 mg/m$^2$ |
| | | High boiling solvent (17) | 90 mg/m$^2$ |
| | | Auxiliary developer (5) | 14 mg/m$^2$ |
| | | Anti-fogging agent (6) | 3.6 mg/m$^2$ |
| | | Surface active agent (18) | 6.5 mg/m$^2$ |
| 5th layer | Blue-sensitive emulsion layer | Water soluble polymer (7) | 6 mg/m$^2$ |
| 4th layer | Intermediate layer | Gelatin | 560 mg/m$^2$ |
| | | Surface active agent (8) | 9 mg/m$^2$ |
| | | Surface active agent (19) | 45 mg/m$^2$ |
| | | Water soluble polymer (7) | 12 mg/m$^2$ |
| 3rd layer | First infrared-sensitive layer | Gelatin | 270 mg/m$^2$ |
| | | Light-sensitive silver halide emulsion (I) | 205 mg/m$^2$* |
| | | Sensitizing dye (12) | 0.06 mg/m$^2$ |
| | | Anti-fogging agent (14) | 0.3 mg/m$^2$ |
| | | Anti-fogging agent (15) | 4 mg/m$^2$ |
| | | Cyan dye-providing material (3) | 180 mg/m$^2$ |
| | | Cyan dye-providing material (4) | 125 mg/m$^2$ |
| | | High boiling solvent (20) | 153 mg/m$^2$ |
| | | Auxiliary developer (5) | 17 mg/m$^2$ |
| | | Anti-fogging agent (6) | 4 mg/m$^2$ |
| | | Surface active agent (18) | 6 mg/m$^2$ |
| | | Water soluble polymer (7) | 10 mg/m$^2$ |
| 2nd layer | Intermediate layer | Gelatin | 630 mg/m$^2$ |
| | | Surface active agent (8) | 6 mg/m$^2$ |
| | | Surface active agent (12) | 57 mg/m$^2$ |
| 2nd layer | Intermediate layer | Water soluble polymer (7) | 9 mg/m$^2$ |
| 1st layer | Third infrared sensitive layer | Gelatin | 320 mg/m$^2$ |
| | | Light-sensitive silver halide emulsion (I) | 216 mg/m$^2$* |
| | | Sensitizing dye (13) | 0.11 mg/m$^2$ |
| | | Anti-fogging agent (14) | 0.8 mg/m$^2$ |
| | | Anti-fogging agent (15) | 5.4 mg/m$^2$ |
| | | Yellow dye-providing material (1) | 400 mg/m$^2$ |
| | | Filter dye (F-1) | 75 mg/m$^2$ |
| | | High boiling solvent (20) | 160 mg/m$^2$ |
| | | Auxiliary developer (5) | 32 mg/m$^2$ |
| | | Anti-fogging agent (6) | 3 mg/m$^2$ |
| | | Surface active agent (18) | 32 mg/m$^2$ |
| | | Water soluble polymer | 14 mg/m$^2$ |
| Support (paper support laminated with polyethylene (thickness: 130 μm) | | | |

*Amount converted to silver

Yellow dye-providing compound (1)

TABLE C-continued
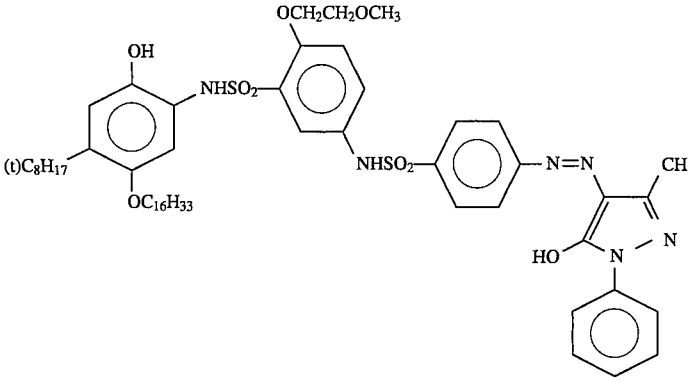
Magenta dye-providing compound (2)
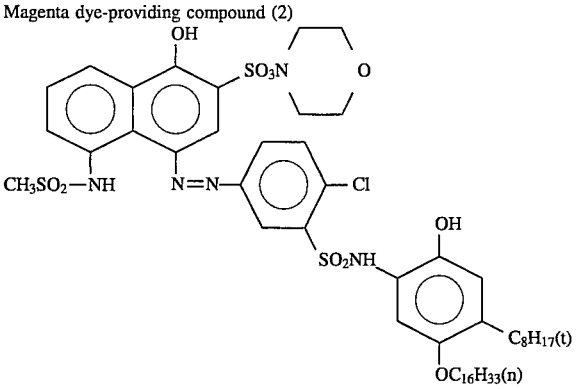
Cyan dye-providing compound (3)
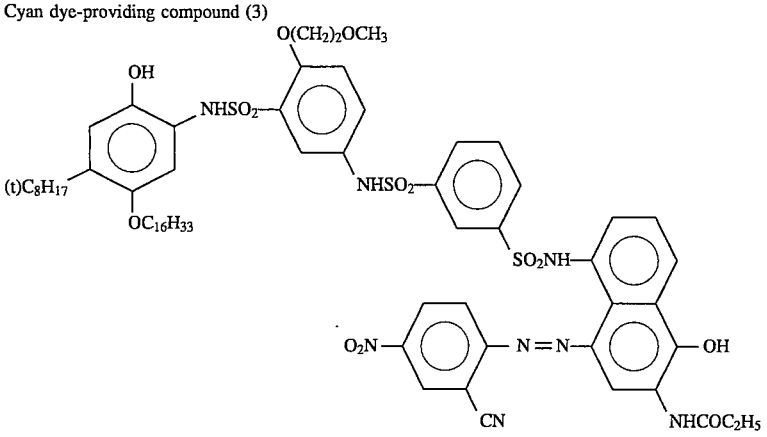
Cyan dye-providing compound (4)
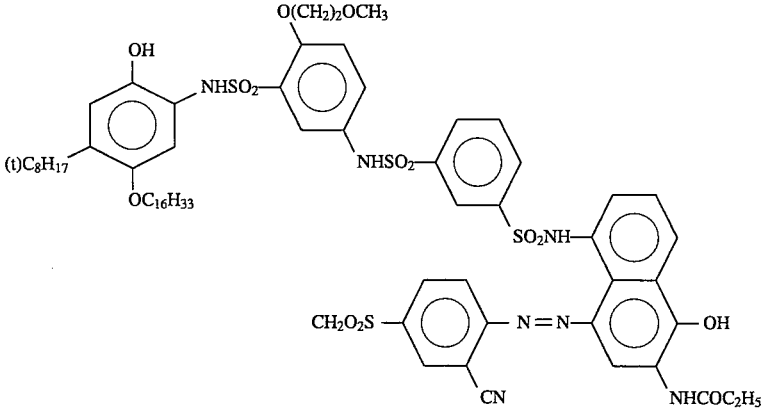

TABLE C-continued
Auxiliary developing agent (5)
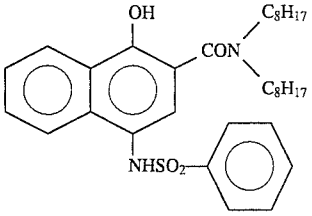
Anti-fogging agent (6)
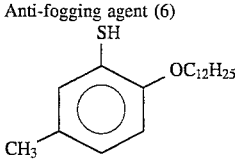
High boiling solvent (1)
iso-$C_8H_{10}O)_3P=O$
High boiling solvent (2)
$(n\text{-}C_6H_{13}O)_3P=O$
Surface active agent (1)
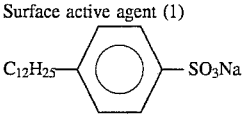
Surface active agent (2)
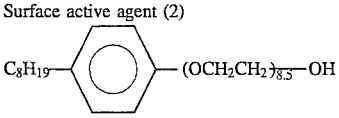
Surface active agent (3)
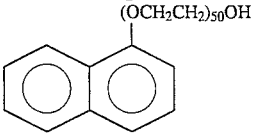
Water soluble polymer (1)
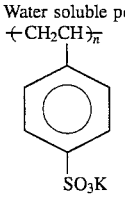
Surface active agent (4)
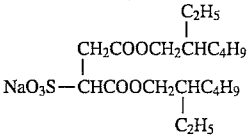
Surface active agent (5)
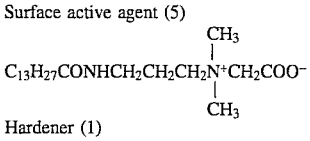
Hardener (1)
1,2-Bis(vinylsulfonylacetamido)ethane
Sensitizing dyes (11)

TABLE C-continued

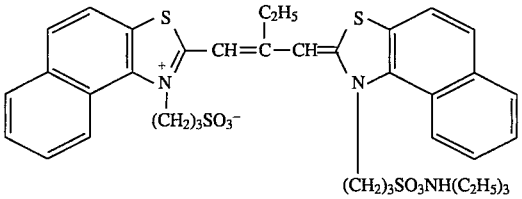

Sensitizing dyes (12)

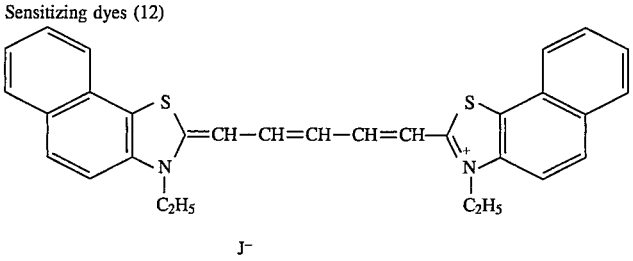

Sensitizing dyes (13)

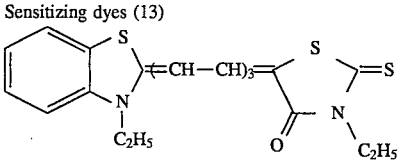

Anti-fogging agents (14)

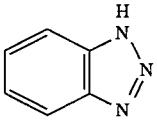

Anti-fogging agents (15)

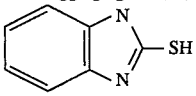

Anti-fogging agents (16)

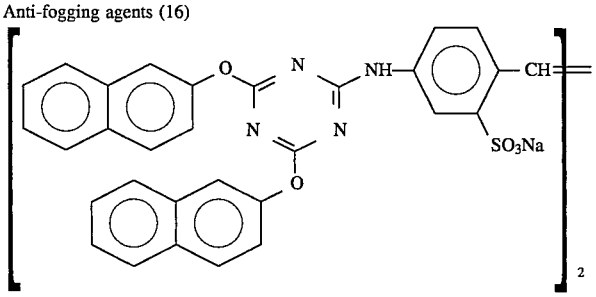

Filter dye F-1

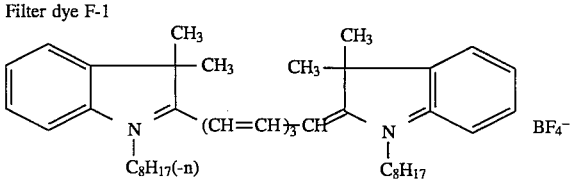

The above light-sensitive element 3 was subjected to laser exposure under the conditions shown in Table 22. Then, the exposed light-sensitive element was dipped in water maintained at 40° C. for 4 seconds, it was squeezed with rollers and immediately superposed on the image-receiving element (the image-receiving elements 201 to 209 in Example 2) so that the layer faces thereof were contacted.

TABLE 22

| Conditions of laser exposure | |
|---|---|
| Beam strength on the light-sensitive material | 1 mW |
| Scanning line density | 800 dpi (32 raster per 1 mm) |
| Beam diameter | 100 ± 10 μm in primary scanning |

TABLE 22-continued

| Conditions of laser exposure | |
|---|---|
| Beam strength on the light-sensitive material | 1 mW |
| | direction<br>800 ± 10 μm in sub-scanning direction |
| Exposing time | 0.9 msec per raster |
| Exposing wavelength | 670 nm (magenta)<br>750 nm (cyan)<br>810 nm (yellow) |
| Exposure | 1 log E change per 2.5 cm in a sub-scanning direction |
| Exposure changing method | Emission time modulation |

Then, heat was applied for 15 seconds with a heat drum adjusted to such a temperature so that the temperature of the wet faces absorbing water reached 80° C. The light-sensitive element was peeled off from the image-receiving element, whereby a color image corresponding to the exposure was obtained on the image-receiving element.

The image-receiving elements 201 to 209 were subjected to the evaluation of a light fastness in the same manner as in Example 1. The results are shown in Table 23.

TABLE 23

Light fastness of a transferred dye

| | Residual rate of dye | | |
|---|---|---|---|
| Image-receiving element | Yellow | Magenta | Cyan |
| 201 (Comparison) | 80 | 63 | 57 |
| 202 (Invention) | 81 | 75 | 65 |
| 203 (Invention) | 83 | 77 | 69 |
| 204 (Invention) | 82 | 75 | 66 |
| 205 (Invention) | 80 | 78 | 69 |
| 206 (Invention) | 81 | 80 | 72 |
| 207 (Invention) | 85 | 85 | 75 |
| 208 (Invention) | 85 | 84 | 76 |
| 209 (Invention) | 84 | 84 | 76 |

The results in Table 23 show that the image-receiving elements 202 to 209, which are the dye fixing elements of the present invention, have excellent light fastness of the transferred dye compared with that of the comparative image-receiving element 201.

EXAMPLE 4

A polyethylene terephthalate film provided on the back face thereof with an anti-heat sliding processing and having a thickness of 6 μm was used as a support. A paint composition for a heat transfer dye-providing layer with the following composition was applied on the surface of the film with a wire bar coating so that the dry thickness became 1.5 μm. The heat transfer dye-providing material 4-Y was thus prepared.

| Paint composition for a heat transfer dye-providing layer: | |
|---|---|
| Dye A* | 10 mmole |
| Polyvinyl butyral resin (Denka Butyral 5000-A manufactured by Denki Kagaku Co.) | 3 g |
| Toluene | 40 ml |
| Methyl ethyl ketone | 40 ml |
| Polyisocyanate (Takenate D110N manufactured by Takeda Pharmaceutical Co., Ltd.) | 0.2 ml |

-continued

Paint composition for a heat transfer dye-providing layer:

Dye A*

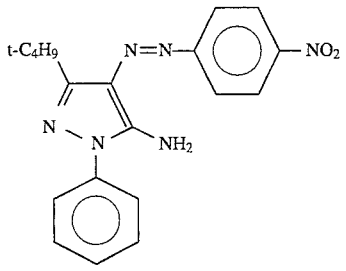

Next, the heat transfer dye-providing materials 4-m and 4-C were prepared in the-same manner as the above except that the above dye A* was replaced with the following dye B and dye C.

Dye B

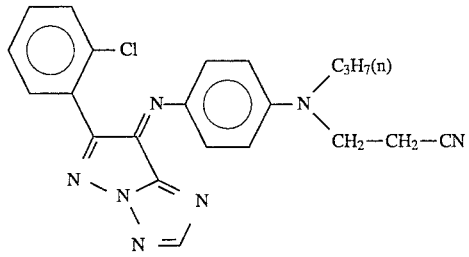

Dye C

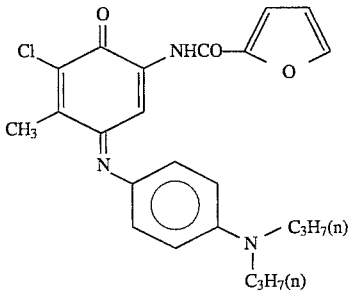

Preparation of the heat transfer image-receiving element 401

A synthetic paper (YUPO-FPG-150 manufactured by Ohji Yuka Co., Ltd.) having a thickness of 150 μm was used as a support. A paint composition for an image-receiving layer with the following composition was applied on the support surface with a wire bar coating so that the dry thickness became 8 μm. The heat transfer image-receiving material was thus prepared. Drying was carried out in an oven at a temperature of 70° C. for 30 minutes after temporarily drying with a dryer.

| Paint composition for the image-receiving layer | |
|---|---|
| Polyester resin (Byron-280 manufactured by Toyobo Co., Ltd.) | 22 g |
| Polyisocyanate (KP-90 manufactured by Dainippon Ink & Chemicals Co., Ltd.) | 4 g |
| Amino-modified silicone oil (KF-857 manufactured Shin-Etsu Silicone Co., Ltd.) | 0.5 g |
| Methyl ethyl ketone | 85 ml |
| Toluene | 85 ml |
| Cyclohexanone | 15 ml |

Next, the heat transfer image-receiving elements 402 to 409 were prepared in the same manner as the above except using the hydrazine derivatives of the present invention shown in the following table (Table 24).

TABLE 24

| Coated amount of hydrazine derivative of the present invention | | |
|---|---|---|
| Image-receiving element | Hydrazine derivative | Coated amount ($g/m^2$) |
| 402 | Compound (6) | 0.33 |
| 403 | Compound (7) | 0.42 |
| 404 | Compound (12) | 0.63 |
| 405 | Compound (18) | 0.51 |
| 406 | Compound (22) | 0.63 |
| 407 | Compound (31) | 0.75 |
| 408 | Compound (32) | 1.11 |
| 409 | Compound (33) | 1.29 |

The heat transfer dye-providing materials 401 to 403 thus obtained were superposed on the heat transfer image-receiving elements 401 to 409 so that the heat transfer dye-providing layers and image-receiving layers were contacted, and the printing was carried out from a support side of the heat transfer dye-providing material with a thermal head under the conditions of a thermal head output of 0.25 W/dot, la pulse duration of 0.15 to milliseconds, and a dot density of 6 dots/mm. The yellow, magenta and cyan dyes were thus fixed on each of the image-receiving elements 401 to 409 and the sharp image did not encounter transfer unevenness.

Next, the images were subjected to the evaluation of a light fastness in the-same manner as in Example 1. The results are shown in Table 25.

TABLE 25

| Light fastness of a transferred dye | | | |
|---|---|---|---|
| | Residual rate of dye | | |
| Image-receiving element | Yellow | Magenta | Cyan |
| 401 (Comparison) | 88 | 60 | 81 |
| 402 (Invention) | 88 | 65 | 81 |
| 403 (Invention) | 89 | 64 | 83 |
| 404 (Invention) | 89 | 67 | 82 |
| 405 (Invention) | 88 | 67 | 82 |
| 406 (Invention) | 90 | 71 | 85 |
| 407 (Invention) | 91 | 75 | 88 |
| 408 (Invention) | 90 | 74 | 87 |
| 409 (Invention) | 90 | 74 | 88 |

As apparent from the results shown in the above table, the image-receiving elements 402 to 409, which are the dye fixing elements of the present invention, have an excellent light fastness of the transferred dye compared with that of the comparative image-receiving element 401.

While the invention has been described in detail and with reference to specific embodiments thereof, it will be apparent to one skilled in the art that various changes and modifications can be made therein without departing from the spirit and scope thereof.

What is claimed is:

1. A dye fixing element comprising a hydrazine derivative represented by the following Formula (I):

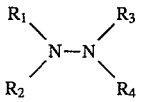

(I)

wherein $R_1$, $R_2$, $R_3$ and $R_4$ each independently represents a substituted or unsubstituted alkyl, cycloalkyl, alkenyl, or aralkyl group, provided that at least one of $R_1$, $R_2$, $R_3$ and $R_4$ has a substituent selected from the group consisting of a carboxylic acid, a salt of a carboxylic acid, a sulfonic acid, and a salt of a sulfonic acid; wherein $R_1$, $R_2$, $R_3$ and $R_4$ may be combined with each other to form a ring, provided that this ring is a non-aromatic heterocyclic ring and the atoms constituting the ring, other than the nitrogens of Formula (I) which are part of the ring, are carbon atoms.

2. The dye fixing element of claim 1, wherein the hydrazine derivative of Formula (I) is represented by formula (V):

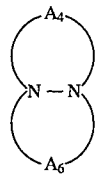

(V)

wherein $A_5$ and $A_6$ each independently represents a group of atoms necessary to form a 4- to 10-membered ring, provided that the atoms constituting each ring, other than the nitrogen atoms shown in Formula (V) which are part of each ring, are carbon atoms.

3. The dye fixing element of claim 1, wherein said element further contains a mordant.

4. The dye fixing element of claim 1, wherein $R_1$, $R_2$, $R_3$ and $R_4$ each independently represents a substituted or unsubstituted alkyl group having a total number of carbon atoms of 1 to 24, provided that at least one of $R_1$, $R_2$, $R_3$ and $R_4$ has a substituent selected from the group consisting of a carboxylic acid, a salt of a carboxylic acid, a sulfonic acid, and a salt of a sulfonic acid.

5. The dye fixing element of claim 1, wherein the hydrazine derivative of Formula (I) has a molecular weight of 200 or more.

6. The dye fixing element of claim 1, wherein the hydrazine derivative of Formula (I) is represented by formula (II):

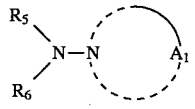

(II)

wherein $R_5$ and $R_6$ each independently represents a substituted or unsubstituted alkyl, cycloalkyl, alkenyl, or aralkyl group, provided that at least one of $R_5$ and $R_6$ has a substituent selected from the group consisting of a carboxylic acid, a salt of a carboxylic acid, a sulfonic acid, and a salt of a sulfonic acid; and wherein $A_1$ represents a group of atoms necessary to form a 4- to 10-membered ring, provided that the atoms constituting the ring, other than the nitrogen atom shown in Formula (II) which is part of the ring, are carbon atoms.

7. The dye fixing element of claim 1, wherein the hydrazine derivative of Formula (I) is represented by formula (III):

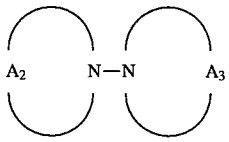

(III)

wherein $A_2$ and $A_3$ each independently represents a group of atoms necessary to form a 4- to 10-membered ring, provided that the atoms constituting the ring, other than the nitrogen atoms shown in Formula (III) which are part of each ring, respectively, are carbon atoms.

8. The dye fixing element of claim 1, wherein the hydrazine derivative of Formula (I) is represented by formula (IV):

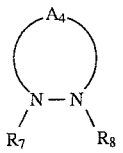

(IV)

wherein $R_7$ and $R_8$ each independently represents a substituted or unsubstituted alkyl, cycloalkyl, alkenyl, or aralkyl group, provided that at least one of $R_7$ and $R_8$ has a substituent selected from the group consisting of a carboxylic acid, a salt of a carboxylic acid, a sulfonic acid, and a salt of a sulfonic acid; and wherein $A_4$ represents a group of atoms necessary to form a 4- to 10-membered ring, provided that the atoms constituting the ring, other than the nitrogen atoms shown in Formula (IV) which are part of the ring, are carbon atoms.

9. A method of forming an image which comprises the steps of (1) providing a silver halide light-sensitive element capable of releasing an anionic azo dye;

(2) providing a dye fixing element comprising a hydrazine derivative represented by the following Formula (I):

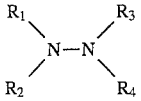

(I)

wherein $R_1$, $R_2$, $R_3$ and $R_4$ each independently represents a substituted or unsubstituted alkyl, cycloalkyl, alkenyl, or aralkyl group, provided that at least one of $R_1$, $R_2$, $R_3$ and $R_4$ has a substituent selected from the group consisting of a carboxylic acid, a salt of a carboxylic acid, a sulfonic acid, and a salt of a sulfonic acid; wherein $R_1$, $R_2$, $R_3$ and $R_4$ may be combined with each other to form a ring, provided that this ring is a non-aromatic heterocyclic ring and the atoms constituting the ring, other than the nitrogens of Formula (I) which are part of the ring, are carbon atoms;

(3) imagewise exposing and developing the light-sensitive element to form a dye image; and (4) transferring the image to the dye fixing element to fix the image in the dye fixing element.

* * * * *